US006976440B2

(12) United States Patent
Ohtani et al.

(10) Patent No.: US 6,976,440 B2
(45) Date of Patent: Dec. 20, 2005

(54) FUEL DISTRIBUTION DEVICE FOR FUEL FEED DUCTS AND METHOD OF OPERATING DISTRIBUTION DEVICE

(75) Inventors: Yoshinori Ohtani, Kure (JP); Hidehisa Yoshizako, Kure (JP); Hiroaki Kanemoto, Kure (JP); Yutaka Takeno, Kure (JP); Yoshio Shimogori, Kure (JP); Toshikazu Tsumura, Kure (JP); Yoshitaka Takahashi, Kure (JP)

(73) Assignee: Babcock-Hitachi Kabushiki Kaisha, Hiroshima (JP)

( * ) Notice: Subject to any disclaimer, the term of this patent is extended or adjusted under 35 U.S.C. 154(b) by 2 days.

(21) Appl. No.: 10/468,956

(22) PCT Filed: Dec. 3, 2001

(86) PCT No.: PCT/JP01/10542

§ 371 (c)(1),
(2), (4) Date: Aug. 22, 2003

(87) PCT Pub. No.: WO03/048643

PCT Pub. Date: Jun. 12, 2003

(65) Prior Publication Data

US 2004/0231572 A1 Nov. 25, 2004

(51) Int. Cl.[7] ..... F23L 13/00; F23D 1/00

(52) U.S. Cl. ..... 110/310; 110/104 R; 110/106; 110/347

(58) Field of Search ..... 110/309, 310, 104 R, 110/106, 347

(56) References Cited

U.S. PATENT DOCUMENTS

| | | | | | |
|---|---|---|---|---|---|
| 333,337 | A | * | 12/1885 | Rehmenklau | 110/106 |
| 1,911,543 | A | * | 5/1933 | Bailey | 406/183 |
| 4,173,189 | A | * | 11/1979 | Cooper | 110/106 |
| 4,552,076 | A | * | 11/1985 | McCartney | 110/347 |
| 4,655,148 | A | * | 4/1987 | Winship | 110/347 |
| 5,421,274 | A | * | 6/1995 | Gordon et al. | 110/232 |

FOREIGN PATENT DOCUMENTS

| | | |
|---|---|---|
| JP | 62-063545 U | 4/1987 |
| JP | 62-070236 U | 5/1987 |
| JP | 07-103542 | 4/1995 |

* cited by examiner

*Primary Examiner*—Kenneth Rinehart
(74) *Attorney, Agent, or Firm*—Intellectual Property Law Group LLP; Otto O. Lee; Juneko Jackson

(57) ABSTRACT

A fuel supply duct, which supplies a mixed fluid of a solid fuel and carrier gas to one or more burners provided on the walls of a furnace, is provided with a branching part, and each of a plurality of branch ducts, which branch out from the branching part, is connected to a corresponding burner. Also a damper, with which the tilt angle with respect to the direction of flow of the mixed fluid can be changed, is positioned in the fuel supply duct at the upstream side of the branching part so that a mutual difference will arise in the solid fuel concentrations of the mixed fluid supplied to the respective branch ducts. A fuel distributor for fuel supply duct is thus arranged. The tilt angle of the above-mentioned damper is adjusted to increase the concentration of solid fuel in the mixed fluid supplied to a specific burner. At a burner to which the high solid fuel concentration is supplied, stability of ignition and stable combustion of the ignited flame can be obtained during low load operation.

16 Claims, 27 Drawing Sheets

FUEL DISTRIBUTION DEVICE FOR FUEL FEED DUCTS AND METHOD OF OPERATING DISTRIBUTION DEVICE

BACKGROUND OF THE INVENTION

1. Technical Field

This invention concerns a fuel distributor for a fuel supply duct, a fuel supply system equipped with the aforementioned fuel distributor, and a combustion system equipped with the aforementioned fuel supply system, and in particular, concerns a fuel distributor for a fuel supply duct that is favorable for improving the combustion characteristics of a brown coal fired boiler.

2. Background Art

FIG. 20 shows an example of a prior art brown coal combustion system for a boiler. The brown coal combustion system and the boiler structure are comprised of a coal hopper 1, a mill 3, which pulverizes the coal supplied from said hopper 1, a fuel supply duct 4, which conveys a mixed fluid made up of the coal particles supplied from said mill 3 and a coal particle carrier gas (hereinafter, the coal particles may be referred to as "pulverized coal" and the mixture of coal particles and coal particle carrier gas may be referred to as "mixed fluid" or "solid-gas two-phase flow"), burners 5, which are connected to the end parts of said fuel supply duct 4, a furnace 8, having burners 5 provided on the side walls thereof, an exhaust gas duct 6, which connects a wall opening of furnace 8 with mill 3 for use of the exhaust gas of the coal particles burnt by said burners 5 as coal particle carrier gas, and a heat exchanger tube 9, which is provided inside said furnace 8.

Lump-form coal A is cut out at a feeder 2, provided at the lower part of hopper 1, and is fed continuously into mill 3. Though a fan mill is used as mill 3 in many cases, the structure of mill 3 is not limited to a fan mill.

At mill 3, the coal is dried by a high-temperature exhaust gas B, which has an oxygen concentration of less than 21% and is introduced from furnace 8 via exhaust gas duct 6, and is pulverized at the same time. The mixed fluid C of coal particles (pulverized coal), obtained by pulverization of granular coal, and exhaust gas is supplied via fuel supply duct 4 to burners 5, which are provided in a plurality of stages in the vertical direction of the side walls of furnace 8. The coal particles supplied to burners 5 are burnt inside furnace 8, thereby forming a flame, and the resulting radiant heat undergoes heat absorption by heat exchanger tube 9 provided at the furnace side walls and the upper part of the furnace and makes steam.

From fuel supply duct 4, the mixed fluid C is distributed among the plurality of stages of burners 5 that are installed on the side walls of furnace 8, and in many cases, burners 5 are arranged in two to four stages. Also, in many cases, these burners 5 of a plurality of stages are provided in the vertical direction of the side walls of furnace 8 for each mill 3 (a plurality of mills are installed for each boiler can). This is because the discharge pressure capacity of fan mill 3 is low in comparison to a normal, centrifugal type turbo blower, etc. That is, the pressure loss at fuel supply duct 4 must be restrained and in order to make fuel supply duct 4 simple and avoid making its length longer than necessary, it is more advantageous to arrange the burner group in the vertical direction than in the horizontal direction.

Next, an example of the method of combustion in the boiler furnace 8 shown in FIG. 20 shall be described.

Though for example when the load of the boiler is low, the amount of coal A supplied to burners 5 is lowered, the flow velocity of the coal particle carrier gas (boiler exhaust gas) in fuel supply duct 4 is kept at a fixed flow velocity so that the flow velocity will not fall below the minimum flow velocity necessary for stable carrying of the coal particles and so as to convey the coal particles, resulting from the pulverization of coal A by mill 3, in a stable manner from mill 3 to burners 5. Thus, when the load of the boiler is low, the concentration of coal particles in the mixed fluid C that is supplied to burners 5 becomes low and the fuel ignition characteristics at burners 5 can become unstable.

As a countermeasure, a part of the plurality of mills 3 is stopped temporarily (mill cutting; e.g. the number of operating mills is changed from four units to two units) and, at the same time, the concentration of coal particles (pulverized coal) in the mixed fluid supplied to the burner 5 of each stage is changed respectively.

The prior art illustrated in FIGS. 27, 28, and 29 are known as art for concentrating the fuel in the fuel supply duct 4 that conveys coal to burners 5. In these fuel concentrating techniques, the concentrations of coal particles supplied to the respective burners at the upper stage side and lower stage side are adjusted.

With the example shown in FIG. 27, a large-diameter main fuel supply duct (main duct) 4 for supplying fuel is provided at the upstream side of the flow path of mixed fluid C, and a small-diameter fuel supply duct (branch duct) 102 is provided at the downstream side of main duct 4. This fuel supply duct (branch duct) 102 is inserted, thereby branching the flow path of mixed fluid C into two ducts, and a lower stage burner 501 and an upper stage burner 502 are connected to the end parts of the respective ducts. With the structure shown in FIG. 27, a conical deflector 105 is installed at the inner part of the large-diameter main duct 4 at the upstream side of the base opening of small-diameter branch duct 102 and the inertial force of the coal particles is used to cause the coal particles to gather towards the inner wall of large-diameter duct 4, thereby making the concentration of coal particles supplied to lower-stage burner 501 higher than the concentration of coal particles supplied to upper-stage burner 502.

With the example shown in FIG. 28, the fuel supply duct (main duct) 4 is branched into three ducts, an upper-stage burner 503, a middle-stage burner 504, and a lower-stage burner 505, which are installed at the ends of the branched branch ducts 107, 108, and 109, respectively. Distributors (dampers) 115 to 117 are installed inside the three branch ducts 107 to 109, respectively, and the respective flow resistances of mixed fluid C in branch ducts 107 to 109 are adjusted by the tilt angles of dampers 115 to 117 to control the flow rate of the mixed fluid.

With the example shown in FIG. 29, a main duct 4, for supplying the fuel conveyed from mill 3, is connected to an upper-stage burner 506 without being changed in cross-sectional area and a branch duct 121, connecting to a lower-stage burner 507, is provided in the middle. This prior art provides the effect that the concentration of coal particles in the mixed fluid C that is supplied to upper-stage burner 506 is increased by the inertial force of the coal particles.

The above-described prior art illustrated in FIG. 27 through FIG. 29 have the problem that with the burners 501 to 507 and the fuel supply ducts connected to the burners 501 to 507, the concentrations of coal in mixed fluid C in the branch ducts connected to main duct 4 cannot be adjusted. Dampers 115 to 117 are installed inside the three branch ducts 107 to 109 respectively as shown in FIG. 28, and though the flow resistance of mixed fluid C, comprised of coal particles and the carrier gas therefore, can be changed within each of branch ducts 107 to 109, it does not enable just the coal particle concentration to be changed selectively.

Also, with the fuel supply duct shown in FIG. 27 and FIG. 29, since members for adjusting the damper and the associated flow path opening are not provided, the concentrations of coal particles in the mixed fluid inside the branch ducts 102 and 121, connected to main duct 4, cannot be changed as suited in accordance to changes in the boiler load.

The above described prior art also have the problem that the distribution of the coal particle concentration in the fuel supply duct (main duct) 4, which supplies mixed fluid C from fan mill 3 to the respective stages of burners 5 in boiler furnace 8, is difficult to adjust.

At main duct 4 in the vicinity of the exit part of fan mill 3, the concentration of coal particles per unit area of the cross unit is not necessarily uniform and there is a distribution of concentration in many cases. This is because the coal particles are introduced into main duct 4 by the centrifugal force of a fan blade 16, which, as shown in FIG. 21, is disposed inside fan mill 3 and is rotated at high speed. FIG. 21 shows the flow conditions of coal in fan mill 3, and the coal that is supplied to fan mill 3 is pulverized finely by the collision with fan blade 16 and the coal particles are pushed towards the inner wall side of housing 17 of fan mill 3 by the centrifugal force resulting from the rotation of fan blade 16. As a result, this gives rise to a bias in the coal particle concentration of the mixed fluid, which is comprised of a solid-gas two-phase flow, at main duct 4 in the vicinity of the exit part of fan mill 3, and a flow d, having a high concentration of coal particles, and a flow d', having a non-high concentration of coal particles, are formed in the cross-sectional direction of main duct 4 (this may be referred to hereinafter as the "bias of the solid-gas two-phase flow").

The centrifugal force of fan blade 16 is mainly determined by the installation position of fan mill 3, the structure of fuel supply duct 4, etc., and it is difficult to ascertain the coal particle concentration distribution in accordance to the differences in the structures of fan mill 3 and burners 5 prior to operation of the coal combustion system.

Also, in the case where a classifier 18, such as shown in FIG. 22, is installed in main duct 4 at the exit part of fan mill 3 in order to make fine the grain size of the coal particles that are conveyed to burners 5 of boiler furnace 8, the above-described bias of the solid-gas two-phase flow strengthens within the main duct 4 that is connected to the downstream part of classifier 18. This action shall now be described using FIG. 22.

The solid-gas two-phase flows d and d' that have been conveyed from fan mill 3 via the main duct 4 at the upstream side of classifier 18 collide with the collision plate 21 provided on classifier 18, and thereafter the rough coal particles f drop in the direction of the entrance of fan mill 3 and are returned to the entrance of the unillustrated fan mill 3 via duct 20. Meanwhile, the fine coal particles e are supplied to the respective burner-stages of furnace 8 via main duct 4 at the downstream side of distributor 18. In this process, the fine coal particles e inside main duct 4 drift, due to inertial force, in the direction of the wall of main duct 4 that is closer to the inner wall of classifier housing 19 that opposes the inner wall of housing 19 at the side at which collision plate 21 of classifier 18 is installed, and a large non-uniformity thus forms in the distribution of the coal particle concentration in the direction of the cross section of main duct 4.

If mixed fluid C is conveyed into each of the branch ducts that branch from main duct 4 with the above-described non-uniformity of coal particle concentration distribution being maintained, coal particle fuel of a suitable concentration may not be supplied to each burner 5. For example, a mixed fluid C of low coal particle concentration may be conveyed to a burner 5 to which a mixed fluid C of high coal particle concentration should be conveyed. Especially in the case where a boiler is to be operated at low load, if a mixed fluid C of low coal particle concentration is conveyed to a burner 5 to which a mixed fluid C of high coal particle concentration should be conveyed, the combustion condition of the flame can become unstable and cause a flame-out.

When a boiler is to be operated at low load, the mill load must be lowered, and though the supply amount of coal is lowered accordingly, the flow rate of the coal carrier gas cannot be lowered below a predetermined flow rate (minimum flow rate) for stable conveying of the coal particles. Thus in order to prevent flame-out, the concentration of coal particles in the mixed fluid C, which is to be supplied to a specific burner among the burners 5 disposed in a plurality of stages in the furnace, must be thickened to secure stability of ignition and the stable combustion of the flame at burner 5.

Furthermore, in the case where brown coal or other coal that contains a high amount of water or ash is used as the boiler fuel, the coal particle concentration range, in which a stable burner flame can be maintained, is determined in accordance to the proportion of water or ash contained in the coal in the actual operation of the boiler.

Also, the stability of the flame of burner 5 is strongly dependent on the coal particle concentration, water concentration, and ash concentration supplied to burner 5, and it is known by experience that the stability of the burner flame is better the higher the coal particle concentration, the lower the water concentration, and the lower the ash concentration. Since coal, such as brown coal, contains a high amount of water or ash, the securing of the stability of the burner flame will be important in the case where brown coal is used as fuel.

FIG. 23 and FIG. 26 show an example of mill cutting (from four units to two units) for low load operation of a furnace 8 provided with burners 5 at the corner parts of opposing walls. FIG. 26 shows the burner flame conditions when the load is even lower than that in the case of FIG. 23. When mill cutting is carried out for low load operation of the boiler and the thermal load within furnace 8 decreases, a stable, high-temperature combustion zone will not be formed at the central part of furnace 8 as shown in FIG. 23 and FIG. 26, and the method of achieving stable combustion by self flame stabilization at each burner is carried out. In this case, unless the coal particle concentration is not adjusted appropriately, the combustion of coal becomes unstable and the stable operation of the boiler is made difficult.

Generally when the boiler load is low, the concentration of coal particles supplied to the burners of specific stages, among the plurality of stages of burners disposed in the vertical direction of the furnace side wall, is increased to stabilize the burner flame combustion at these specific stages and the stability of combustion of the furnace as a whole is thereby secured. However, even if high amounts of concentrated coal particles are supplied to burners of specific stages and the burner ignition stability is improved, the exhaust gas temperature at the furnace exit decreases due to the relationship between heat absorption by the furnace walls in the furnace height direction and the flame temperature distribution within the furnace, thereby preventing the obtaining of the predetermined steam temperature. For ignition stability of the coal and for making the temperature of the furnace exit exhaust gas the predetermined temperature, the adjustment of the concentrations of coal particles supplied to the respective burners 5 disposed in the upper and lower stages becomes important.

An object of this invention is to provide a fuel distributor for a fuel supply duct, by which solid fuel can be supplied to a burner in a manner whereby ignition stability and stable combustion of the ignited flame can be achieved even when the load of a boiler is low; a fuel supply system that is equipped with the aforementioned fuel distributor for a fuel supply duct; and a fuel combustion device that is equipped with the aforementioned fuel supply system.

Another object of this invention is to provide a fuel distributor for a fuel supply duct, which is equipped with the function of deflecting solid fuel of high concentration in a mixed fluid, comprised of the solid fuel and carrier gas, in an intended direction; a fuel supply system that is equipped with the aforementioned fuel distributor for a fuel supply duct; and a fuel combustion device that is equipped with the aforementioned fuel supply system.

Also, generally during full load (100% load) operation of a boiler, an example of which is shown in FIG. 20, the temperature of the gas exiting the boiler furnace is set so that after the gas undergoes heat absorption by heat exchanger walls, which are installed along the gas flow path at the downstream side of the exit of furnace 8, and by a heat exchanger tube 9, which is installed inside the abovementioned gas flow path, and reaches an unillustrated posterior heat exchanger part of the furnace, the gas temperature will be lower than the melting point of the ash contained in the gas. The temperature of the gas exiting the boiler furnace during full load operation of the boiler is also set so that the metal temperature of the surface of an unillustrated heat exchanger tube installed at the above-mentioned posterior heat exchanger part will not be raised excessively to or above the heat resistant temperature of the surface.

However, when the boiler undergoes the transition from full load operation to partial load operation, sine the amount of heat input into furnace 8 decreases, the gas temperature at the boiler furnace exit decreases and the steam temperature at the boiler exit falls below the steam temperature required at the turbine entrance at the steam demanding end (this temperature may also be referred to as the "steam temperature required at the demanding end").

Thus another object of this invention is to provide a fuel distributor for a fuel supply duct, with which when a boiler that uses a mixed fluid, comprised of solid fuel and a carrier gas therefore, is switched from full load operation to partial low operation, the temperature of the gas at the boiler furnace exit is prevented from dropping excessively so that the steam temperature at the boiler exit will not become less than or equal to the steam temperature required at the demanding end, and a method of operating a boiler equipped with the said fuel distributor for fuel supply duct.

SUMMARY OF THE INVENTION

This invention provides a fuel distributor for a fuel supply duct, comprised of a fuel supply duct, which supplies a mixed fluid, comprised in turn of a solid fuel and carrier gas (for example, combustion exhaust gas or other gas with an oxygen concentration of less than 21%), to each of one or more burners disposed at walls or corner parts formed by walls of a furnace; a plurality of branch ducts, which branch out from a branching part provided in the above-mentioned fuel supply duct and each of which is connected to a corresponding burner; and a damper, which is disposed inside the fuel supply duct at the upstream side of the branching part and can be changed in the tilt angle with respect to the flow of the mixed fluid so that a mutual difference will arise in the solid fuel concentrations of the mixed fuel supplied to the respective branch ducts.

A damper pivoting axis, for changing the tilt angle of the above-mentioned damper in the above-described fuel distributor for the fuel supply duct (main duct), is preferably provided at the end part of the damper (see FIG. 2) or the central part of the damper (see FIG. 4) and this damper pivoting axis is preferably disposed at or near the central part of the duct at a part that is upstream the above-mentioned branching part.

With the above-described fuel supply duct, which is provided at the downstream side with branch ducts that are respectively connected to each of a plurality of burners that open into the furnace, the distribution ratio of the solid fuel carrier gas in the mixed fluid, comprised of a solid-gas two-phase flow, can be made constant and the concentration of the solid fuel can be thickened in an arbitrary direction by adjusting the tilt angle of the damper provided at the upstream side of the above-mentioned part that branches out to the branch ducts. This is enabled since the pressure loss between the damper and the entrances of the respective branch ducts is small in comparison to the total pressure loss from the upstream side of the branching part of the fuel supply duct, through the branch duct burners, and into the furnace, and the distribution ratio of the carrier gas can thus be made constant and inertial separation of just the solid fuel becomes possible. The solid fuel particles can thus be made to undergo a biased flow towards a selected path (each branch duct).

Generally, a combustion system, with which solid fuel particles are supplied via a single fuel supply duct to a plurality of burners installed at upper and lower stages of a furnace, is employed. When the tilt angle of the damper is adjusted so that more of the above-mentioned mixed fluid, comprised of a solid phase and a gas phase, will flow towards a branch duct of a specific burner among the plurality of burners, though the solid phase and gas phase will tend to maintain the above-mentioned biased flow by inertia even after passage through the damper installed part, the gas phase, which is low in density and thus small in inertia, loses its inertia rapidly and will tend to flow uniformly into the branch ducts that are connected to the respective burners. Meanwhile, with the solid phase, which is high in density, the above-mentioned biased flow is more readily maintained due to the large inertia. Non-uniform distribution of the solid fuel concentration among the respective branch ducts (the non-uniform distribution characteristics) will thus be maintained.

By the above principle, a large part of the solid phase is made to flow selectively towards a branch duct connected to a specific burner. This can be said to be a type of inertial classification, and this type of classification shall be referred to as inertial classification that is axially asymmetric with respect to the direction of flow (principal axis direction) of the solid-gas two-phase flow in the fuel supply duct (main duct) in order to distinguish it from the distribution method to be described below.

For coal to self-ignite at a burner, a heat input (calorific value of the supplied coal), coal concentration, and oxygen of more than or equal to fixed amounts are necessary. However, due to use of boiler exhaust gas of low oxygen concentration as the coal particle (pulverized coal) carrier gas that is supplied to the mill and due to water vapor, which is generated by the drying of coal at the mill, being added anew to the mixed fluid, the mixed fluid that is supplied to the burner is significantly low in oxygen concentration (few % to 15%).

Thus in distributing the mixed fluid among a plurality of burners from the same mill via the fuel supply duct, the self ignition characteristic of the fuel at a specific burner can be maintained by securing the minimum necessary heat input amount and coal concentration for that specific burner. A flame can thus be formed and maintained at least at one burner per mill in the furnace.

In the case where brown coal, which is low in calorific value and high in water content, is used as the solid fuel, it is important to heighten the solid phase concentration for a specific burner among the plurality of burners to which brown coal is supplied from the same mill. By doing so, flame-out at the above-mentioned specific burner can be avoided even in the case where the load of the furnace using brown coal as fuel is low.

Also with the present invention, an arrangement, wherein the following relationship holds for the distance L, from the above-mentioned damper pivoting axis to the above-mentioned branching part in the direction of flow of mixed fluid, and the diameter D of the fuel supply duct, is preferable (see FIG. 7):

$$L/D=0.4 \text{ to } 2$$

Generally, a combustion system, with which solid fuel particles are supplied via a fuel supply duct to a plurality of burners installed at upper and lower stages of a furnace, is employed, and when the said L/D falls outside the above range, the solid fuel's ratio of concentration of coal towards a specific burner becomes poor.

When the above-defined L/D is less than 0.4, the ratio of concentration of solid fuel towards a specific burner becomes poor and flame-out may occur at this burner when low load operation, in which the amount of fuel supplied to the furnace is decreased as a whole, is performed. When L/D exceeds 2, the distance between the damper and the duct branching part will be too long and the phenomenon, in which the high-concentration solid fuel particles that have been distributed to be fed towards a specific burner is made uniform in distribution again in the fuel supply duct, will occur, thus preventing the concentration of high-concentration solid fuel towards the above-mentioned specific burner. Thus in order to maintain a high ratio of concentration of solid fuel particles towards a specific burner among the burners that are installed in a plurality of stages, the distance L, between the upper end of the damper and the duct branching part, is preferably made 0.4 to 2 times the diameter D of the fuel supply duct.

Also, an arrangement in which the tilt angle of the above-mentioned damper with respect to the direction of flow of the mixed fluid can be varied within a range of ±40° is preferable.

When the above-mentioned damper tilt angle is 30° or more, the ratio of concentration of coal particles towards a specific burner among the upper and lower stage burners becomes saturated and the pressure loss at the damper installed part of the fuel supply duct increases. The above-mentioned damper tile angle is thus preferably set to approximately ±30° and it is practical for the tilt angle to be adjustable within a range of 40° at the most.

A rotating vane for stirring the flow of the mixed fluid may be provided in the above-described fuel supply duct at the upstream side of the above-described damper (see FIG. 15). In this case, a strong, mechanical rotation can be applied by the rotating vane to the flow of the solid-gas two-phase flow in the fuel supply duct, and thus even when a biased flow occurs in the fuel supply duct at the upstream side of the rotating vane, the biased flow can be corrected forcibly by means of the rotating vane.

The above-mentioned fuel supply duct in the fuel distributor for a fuel supply duct by this invention is positioned so that the mixed fluid will flow in the vertical direction and may have an arrangement having a first fuel supply duct 4*a*, in which the above-described damper is installed, and a second fuel supply duct 4*b*, which is provided at the upstream side of the first fuel supply duct 4*a* and is connected in a bent manner to the first fuel supply duct 4*a* (see FIG. 10 and FIG. 14).

Here, the above-mentioned second fuel supply duct 4*b* is preferably bent in a direction by which the mixed fluid will be guided so as to enhance the difference, in the solid fuel concentrations in the mixed fluid supplied to the respective branch ducts, that is caused by the above-mentioned damper.

When the fuel supply duct has the above-mentioned bent connected part (elbows E and E' in FIG. 10 and FIG. 14), the bent connected part acts to form a biased flow especially for the solid phase of the solid-gas two-phase flow. By setting the directionality of this biased flow to match the directionality of the biased flow generated by an axially asymmetric inertial classification type damper, the non-uniform distribution characteristic (the biasing of the solid phase or concentrating of the solid phase towards a certain region) of the fuel supply duct at the downstream side of the damper installed part is improved, and the coal particle distribution characteristic of the damper of this invention will not be canceled out by the biased flow of the solid-gas two-phase flow in the fuel supply duct at the upstream side.

Also, a third fuel supply duct 4*c*, which causes the mixed fluid to flow in the vertical direction, may be connected at the upstream side of the above-described second fuel supply duct 4*b*.

In this case, first fuel supply duct 4*a*, second fuel supply duct 4*b*, and third fuel supply duct 4*c* form elbows E and E' at two locations, i.e. an upper location and a lower location, in the entire fuel supply duct (FIG. 14). An offset O is thus set between the principal axes of the first fuel supply duct 4*a* and third fuel supply duct 4*c*, which are positioned in the vertical direction. Due to this offset O, the mixed fluid that has passed through the third fuel supply duct 4*c* collides with the upper part of the wall of second fuel supply duct 4*b*, the direction of flow of the mixed fluid, comprised of a solid-gas two-phase flow, changes, and upon reaching the damper in the first fuel supply duct 4*a*, the direction of flow is changed in the opposite direction. The effect of biasing the solid phase flow in the mixed fluid can thus be achieved at low pressure loss and a large amount of coal particles can be made to flow at a higher concentration to a branch duct connected to a specific burner.

Also with the fuel distributor for a fuel supply duct of this invention, a restrictor, which restricts the flow of the mixed fluid, may be provided in the fuel supply duct at the upstream side of the damper (see FIG. 16 and FIG. 17).

By providing the above-mentioned restrictor in the fuel supply duct, the flow of the mixed fluid, comprised of a solid-gas two-phase flow, is converged once towards the principal axis of the fuel supply duct and then dispersed after passage through the restrictor. The coal particle concentration distribution in the cross-sectional direction of the fuel supply duct thus becomes uniform once upon passage through the restrictor and thereafter, a mixed fluid that is high in coal particle concentration at the side of a specific branch duct is made to flow by means of the damper.

Thus even when a biased flow forms in the fuel supply duct such that the solid-gas two-phase flow is made high in solid concentration towards a branch duct for a specific burner for which the solid concentration should not be made high, as long as this biased flow lies at the upstream side of the restrictor, it will not be able to heighten the concentration of solid particles in the solid-gas two-phase flow to be supplied to the specific burner.

Also, by providing the above-mentioned restrictor with an arrangement that enables the degree of restriction to be changed so as to enhance the difference, in the solid fuel concentrations of the mixed fluid to be supplied to the respective branch ducts, that is caused by the above-described damper, the solid particle concentration that passes through a specific branch duct among the plurality of branch ducts can be readily increased or adjusted otherwise.

This invention also includes a fuel supply system, with which the above-described fuel distributor for fuel supply duct is disposed between a solid fuel pulverizing mill and the respective burners provided on the walls of a furnace, and a solid fuel combustion system, equipped with the aforementioned fuel supply system.

Also with this invention's fuel distributor for a fuel supply duct, a branch duct damper, by which the opening area of a branch duct can be changed from a fully open condition to a fully closed condition, may be provided inside at least a branch duct that is connected to a specific burner among the plurality of burners disposed in the height direction of the furnace walls or corner parts formed by the walls (see FIG. 24 and FIG. 25).

The following operation method may be employed for a solid fuel combustion boiler equipped with the above-described fuel supply system provided with a fuel distributor in which a damper is positioned inside a branch duct.

That is, this operation method is a solid fuel combustion boiler operation method, in which coal particles, which have been pulverized by a single coal pulverizing mill, are supplied, along with a carrier gas and via a fuel supply duct and a plurality of branch ducts that branch out from the above-mentioned fuel supply duct, to each of the burners that correspond respectively to the branch ducts and are provided in a plurality of stages in the height direction of the walls of a furnace or corner parts formed by the walls of a furnace. Further, with this solid fuel combustion boiler operation method, a damper, which can be changed in tilt angle with respect to the direction of flow of a mixed fluid, comprised of solid fuel and carrier gas, is provided inside the fuel supply duct at the upstream side of the above-mentioned branch ducts. A damper, by which the opening area of a branch duct can be changed from a fully open condition to a fully closed condition, is provided inside at least a branch duct, among the above-mentioned branch ducts, that is connected to a burner at a lower stage, the above-mentioned fuel supply duct damper is adjusted and the damper in the branch duct connected to the lower stage burner is operated in the opening direction so as to supply the coal particles in a concentrated manner when the boiler is started up. When by the change of load after stabilization of combustion, the load changes from a high load to a low load, the above-mentioned damper in the branch duct connected to the lower stage burner is operated in the closing direction.

By adjusting the fuel supply duct damper and supplying the coal particles in a concentrated manner into the branch duct that is connected to the lower stage burner in the process of starting up the boiler, fuel combustion can be secured at the lower stage burner during the startup of the boiler at which the combustion of fuel is unstable.

Also, by operating the above-mentioned damper in the branch duct connected to the lower stage burner in the closing direction when the boiler changes to low load operation after the high load operation condition in which stable combustion of fuel is carried out, the furnace exit gas temperature can be made adequately high for securing the steam temperature required at the demanding end and prevents problems that arise from the lowering of the steam temperature.

DETAILED DESCRIPTION OF SPECIFIC EMBODIMENTS

Figure 20:
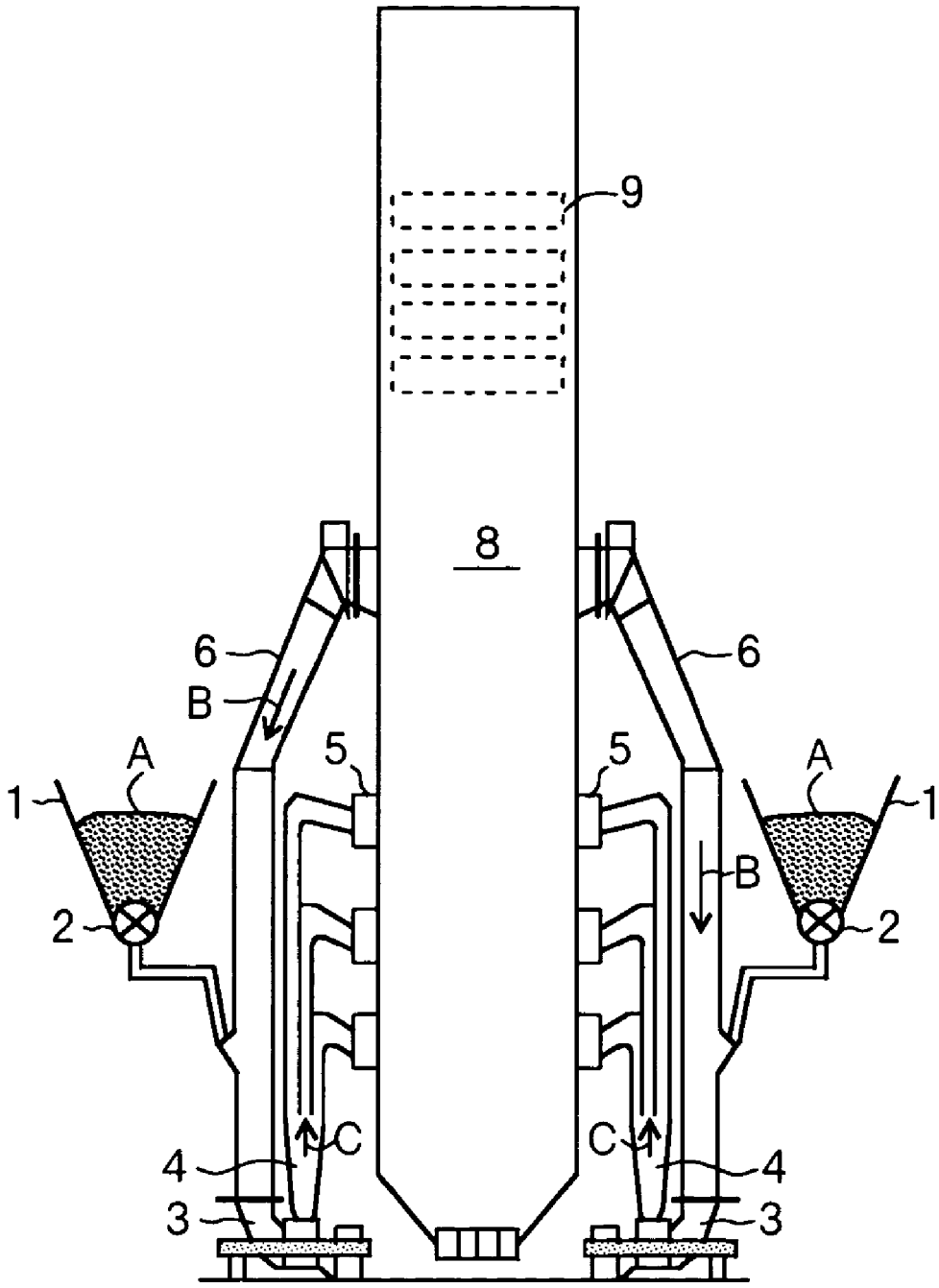
FIG. 20 is an explanatory diagram of a fuel supply system for a brown coal fired boiler.

Embodiments of this invention shall now be described in line with the drawings. The embodiments described below are for a fuel supply duct 4, which extends in the vertical direction and which uses furnace exhaust gas as the carrier gas to convey brown coal, pulverized by a fan mill 3, to burners 5 of a furnace 8 of a brown coal burning boiler as shown in FIG. 20. The above-mentioned burners 5 are provided at a plurality of stages in the vertical direction of side walls of furnace 8, and fuel is supplied by the fan mill 3 corresponding to the respective burners 5 and via the fuel supply duct 4 to be described below. The fuel supply system for burners 5 of the embodiments of this invention to be described below, are equipped with a fuel supply duct 4, with which concentration distribution and flow volume distribution of coal particles in the fuel supply duct 4 at the upstream side of a damper, which is a component of the fuel supply system, can be adjusted to make the concentration of coal particles that flow through a branch duct 4 connected to a lower stage burner 5 of boiler furnace 8 higher than the concentration of coal particles that flow through a branch duct 4 connected to a higher stage burner 5. Also, though examples in which fuel supply duct 4 is branched into two ducts that are connected to an upper stage burner and lower stage burner, respectively, are illustrated by the respective embodiments of this invention to be described below, the fuel supply duct 4 of this invention is not restricted to such a two-branch structure.

First Embodiment

Figure 1:
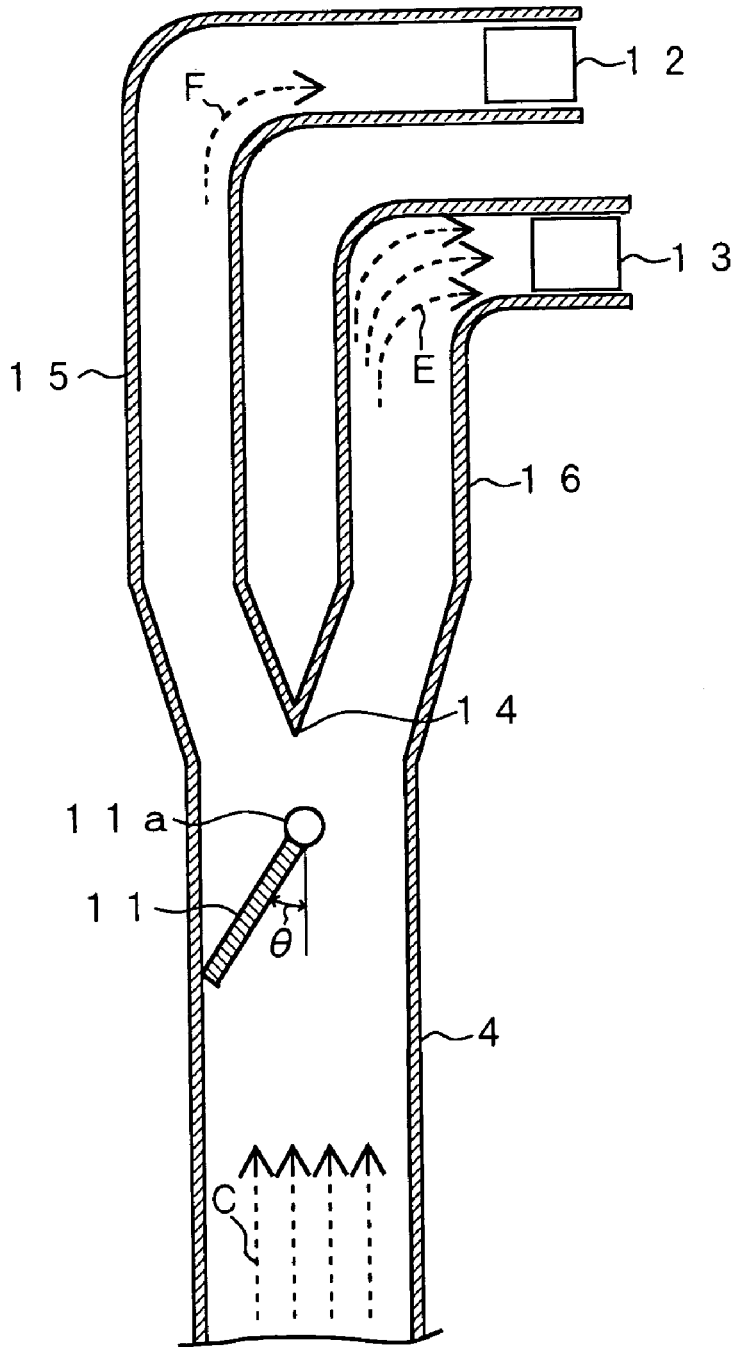
FIG. 1 is a longitudinal sectional view of a fuel supply duct of a first embodiment of this invention.
Figure 2:
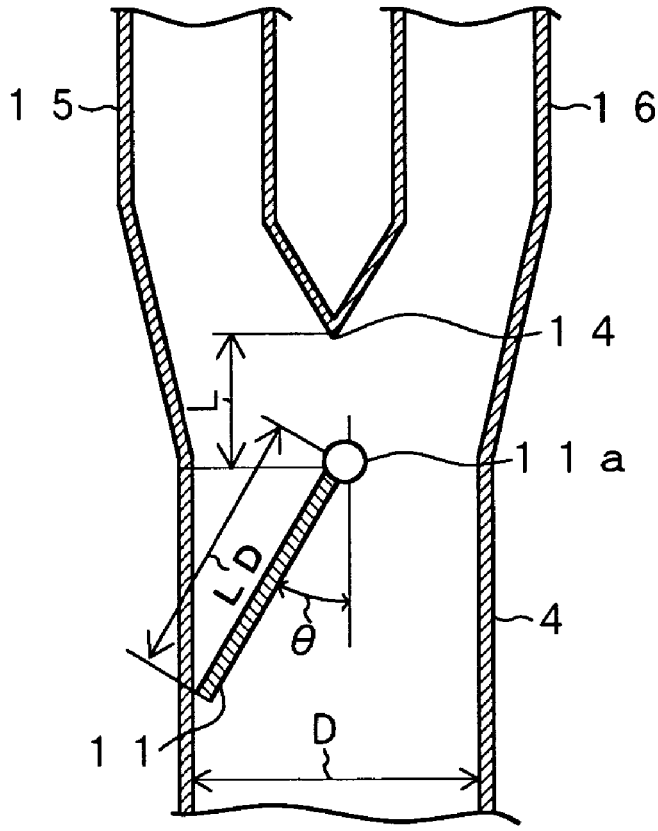
FIG. 2 is a detailed longitudinal sectional view of the fuel supply duct of FIG. 1.

FIG. 1 is a sectional view of the principal parts of the fuel supply duct of this embodiment and FIG. 2 shows the detailed structure around the damper that is installed in the fuel supply duct of FIG. 1.

The fuel feeding piping of FIG. 1 is comprised of a main duct 4, which extends in the vertical direction, a damper 11, which is installed at an upstream part inside main duct 4 in the vicinity of a duct branching point 14, and branch ducts 15 and 16 that result from the branching and are connected to an upper stage burner 12 and a lower stage burner 13, respectively.

With damper 11, a damper pivoting axis 11*a* is disposed in the direction of crossing the main duct 4 in the vicinity of the central part of main duct 4 as shown in FIG. 2.

Figure 3:
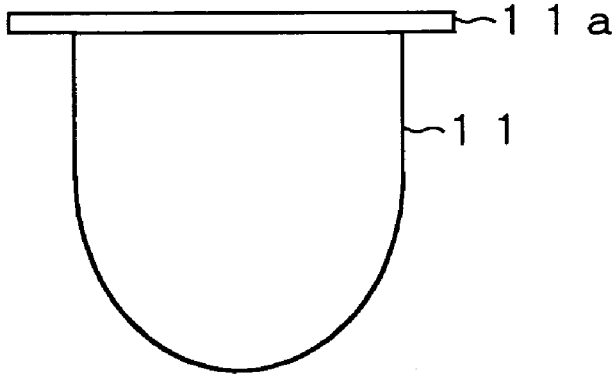
FIG. 3 is a plan view of the damper used in the fuel supply duct of FIG. 1.

As shown in FIG. 2, damper pivoting axis 11*a* is installed at the upper end part of damper 11 with this embodiment. As shown by the plan view of damper 11 in FIG. 3, damper 11 has a substantially semicircular shape and damper pivoting axis 11*a* is provided at the straight part at the upper end of damper 11.

Damper 11 has an arrangement wherein by rotation of damper pivoting axis 11*a*, the tilt angle θ of damper 11 with respect to the vertical line (shall be referred to hereinafter simply as "tilt angle of damper 11) is set to an appropriate angle, and damper 11 can be held at this position.

Second Embodiment

Figure 4:
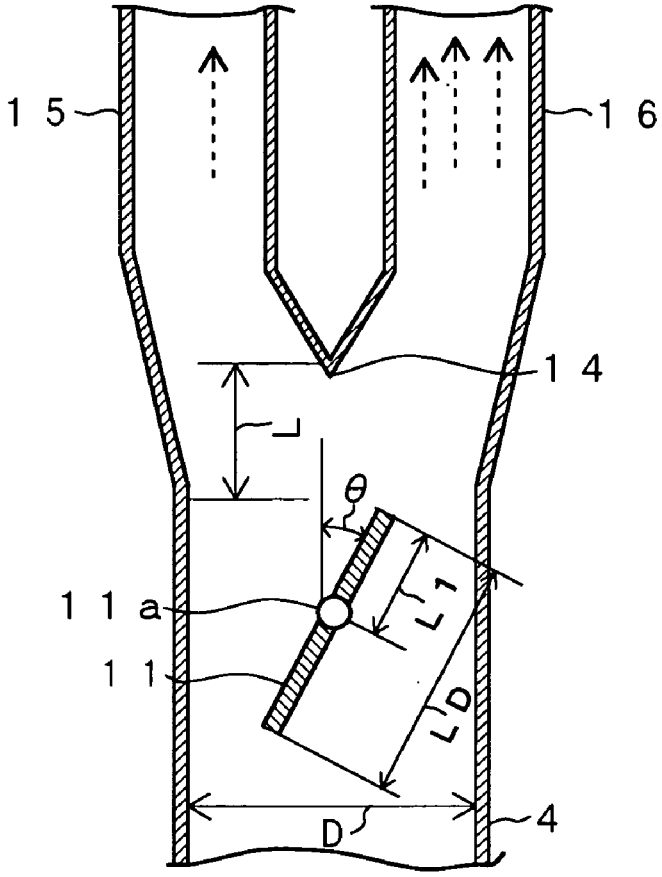
FIG. 4 is a detailed longitudinal sectional view of a fuel supply duct of a second embodiment of this invention.
Figure 5:
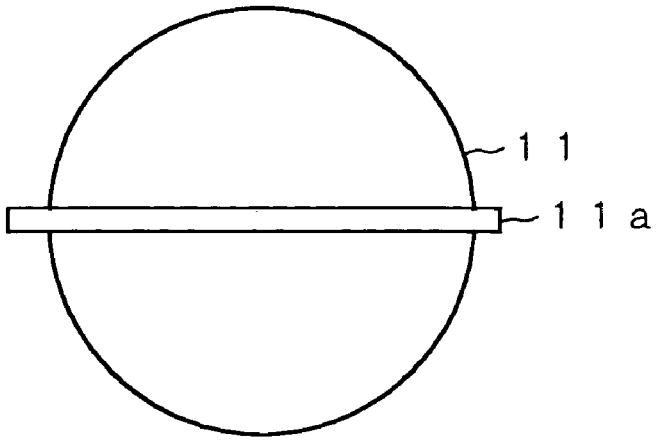
FIG. 5 is a plan view of the damper used in the fuel supply duct of FIG. 4.

FIG. 4 is a longitudinal sectional view of the principal parts of the fuel supply duct of this embodiment, which is a variation of the first embodiment and FIG. 5, is a plan view of the damper of FIG. 4. Damper 11 has a circular shape that is the same as the cross-sectional shape of main duct 4.

Damper 11 can be held at an appropriate tilt angle θ upon rotation of damper pivoting axis 11*a* in this case as well.

Figure 6:
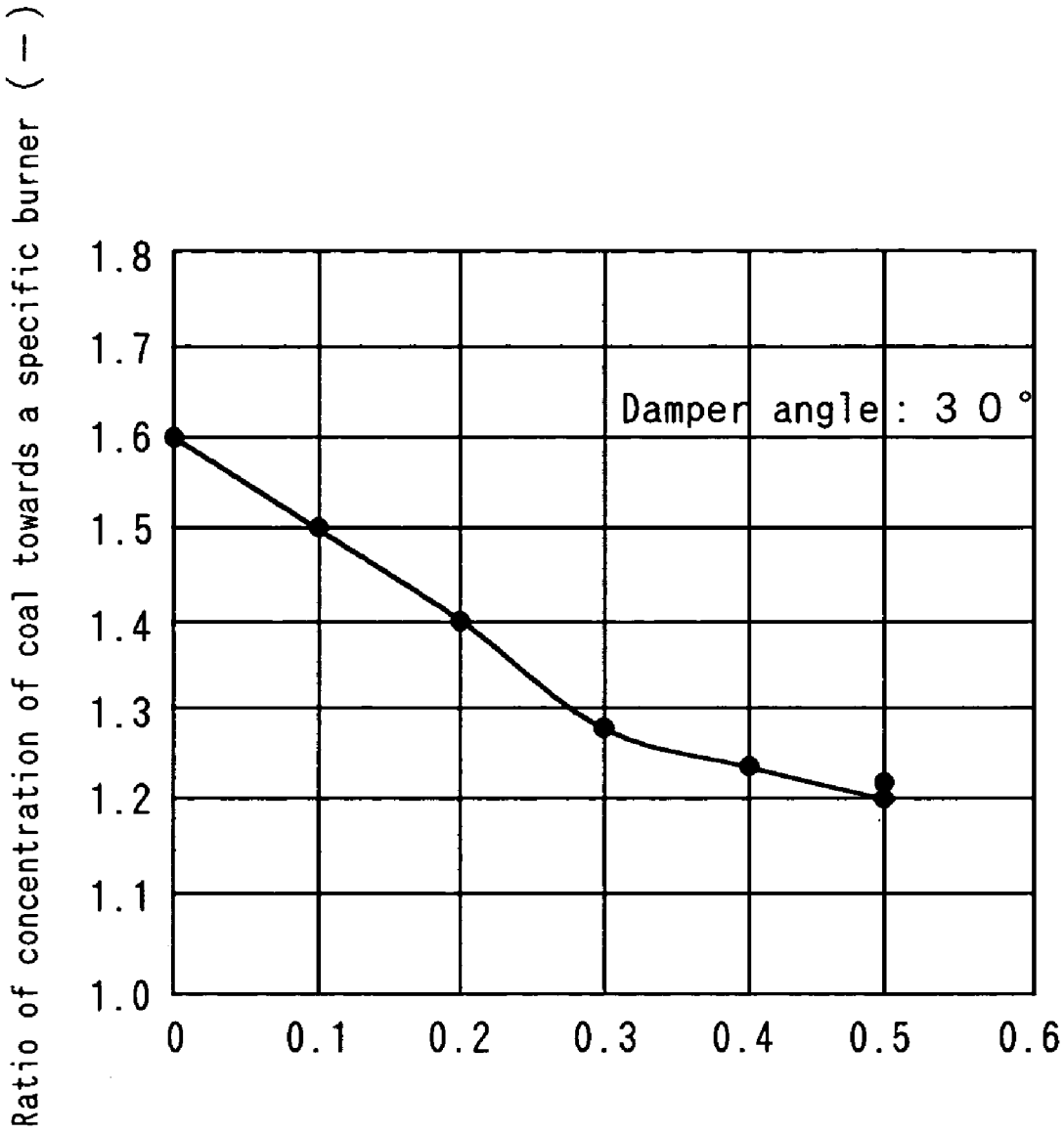
FIG. 6 is a diagram, which illustrates the performance of distribution of coal particles to a lower stage burner by the first embodiment and the second embodiment of this invention.

FIG. 6 shows the relationship between the ratio of concentration of coal towards lower stage burner 13 in the first embodiment and second embodiment and the value of (L1/LD), which is the ratio of the length (L1) from the upper end of damper 11 to pivoting axis 11*a* with respect to the maximum width (LD) of the damper. The ratio of concentration of coal towards lower stage burner 13 is the ratio of the coal concentration that is supplied to branch duct 16 at the lower stage burner side with respect to the coal concentration in the mixed fluid in main duct 4.

As indicated by the (L1/LD) values when the tilt angle θ of damper 11 with respect to the direction in which the mixed fluid flows through main duct 4 (vertical direction) is 30°, a mixed fluid C of the highest coal particle concentration can be concentrated towards lower stage burner 13 when the length L1=0 (first embodiment).

Also, when (L1/LD)=0.4 or more, though the distribution will be practically constant, the pressure loss of damper 11 becomes high. Since the discharge pressure capacity of fan mill 3 (FIG. 1) is low in comparison to a normal, centrifugal type turbo blower, etc., the pressure loss within branch ducts 15 and 16 that branch out from main duct 4 must be restrained to a low level.

From the above, it can be understood that with the arrangements of the first embodiment and second embodiment, the position of damper pivoting axis 11*a* is preferably set within the range from the upper end of the damper to a point halfway across the maximum width (LD) of damper 11.

Figure 7:
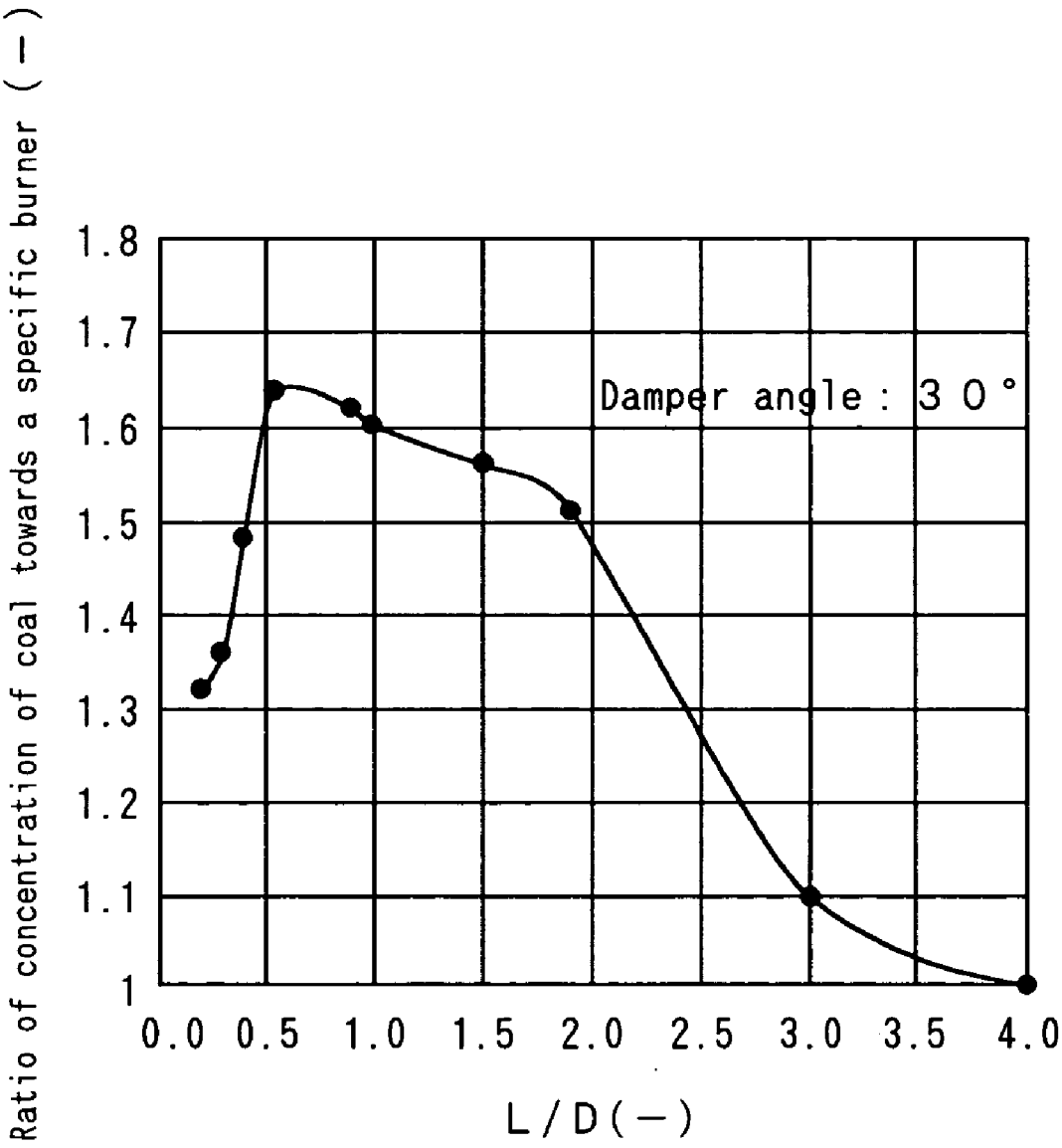
FIG. 7 is a diagram, which illustrates the performance of distribution of coal particles to a lower stage burner by the first embodiment and the second embodiment of this invention.

FIG. 7 shows the results of examining the relationship between the position of installation of damper 11 and the ratio of concentration of coal towards lower stage burner 13 when the tilt angle θ of damper 11 is set to 30° for the second embodiment shown in FIG. 4.

Here, the relationship of the ratio of concentration of coal towards lower stage burner 13 that was determined based on the ratio of the distance L between the upper end of the damper and branching point 14 with respect to the diameter D of main duct 4 was examined.

When the distance L is small in comparison to the diameter D of damper 11, that is, when L/D becomes less than 0.4, the ratio of concentration of coal towards lower stage burner 13 becomes poor. This is considered to be because the resistance of damper 11 against the flow of the mixed fluid increases, and since the amount of gas that flows into branch duct 16 that is connected to lower stage burner (the burner for which the coal is concentrated to fortify the ignition characteristic) 13 thus also increases, the coal concentration inside the above-mentioned branch duct 16 does not increase so much. On the other hand, when L/D exceeds 2.0, the coal particles that are directed once towards branch duct 16 at the lower stage burner 13 side are re-dispersed inside main duct 4 before reaching branch duct 16 and the ratio of concentration of coal towards lower stage burner 13 thus decreases. Therefore in order to increase the ratio of concentration of coal particles towards lower stage burner 13, the distance L, between the upper end of the damper and branching point 14, is preferably made 0.4 to 2 times the fuel supply duct diameter D.

Figure 8:
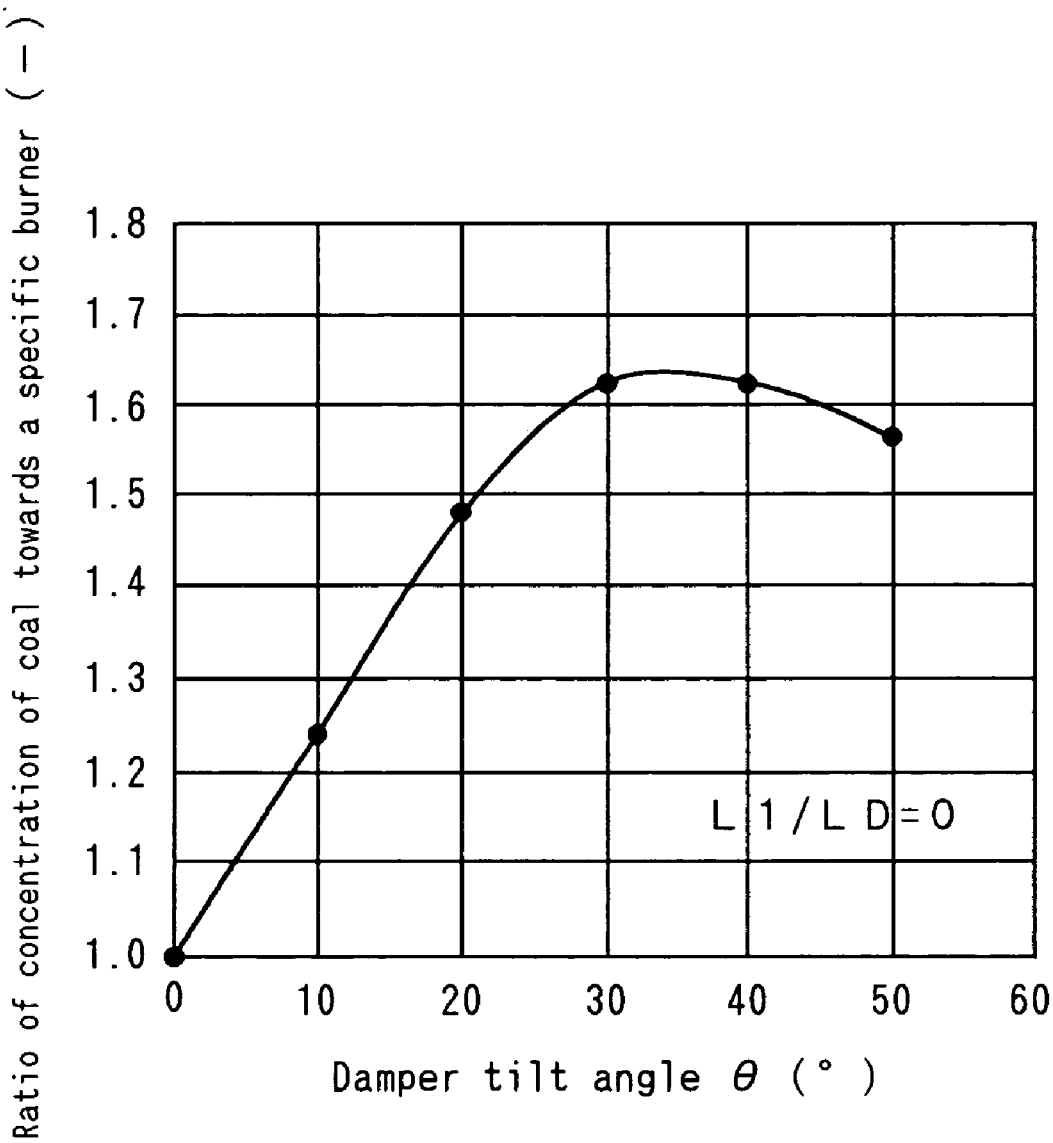
FIG. 8 is a diagram, which illustrates the performance of distribution of coal particles to a lower stage burner by the first embodiment and the second embodiment of this invention.

The only operation by which the ratios of concentration of coal particles from main duct 4 towards upper stage burner 12 and lower stage burner 13 can be adjusted during trial operation of the boiler is the operation of the tilt angle θ of damper 11. FIG. 8 shows the test results of the relationship of the tilt angle θ of damper 11 and the ratio of concentration of coal particles towards lower stage burner 13. It has become clear that when the damper tilt angle θ is 30° or more, the above-mentioned distribution ratio saturates and the pressure loss (not shown) at the damper installed part of main duct 4 increases. When the damper tilt angle becomes 30° or more, though the amount of coal particles directed towards the branch duct to which coal is intended to be concentrated towards increases, it is considered that the ratio of coal concentration does not change since the amount of gas also increases in a likewise manner.

As has been mentioned above, since the pressure loss of mixed fluid C inside branch ducts 15 and 16 must be restrained to a low level, the damper tilt angle θ is preferably set to approximately ±30° with respect to the vertical line that passes through the pivoting axis 11*a* of damper 11 and it is practical for the tilt angle to be adjustable within a range of 40° at the most.

In the cases of the above-described first and second embodiments, the flow of mixed fluid C, which is carried from fan mill 3 (see FIG. 20) by the boiler exhaust gas as shown in FIG. 1, collides with the damper 11, which is installed inside main duct 4 and is held at a tilt angle θ with respect to the vertical direction, and becomes a biased flow. The coal particles, which are the solids, flow as a coal particle flow F, which is low in coal concentration and flows mainly towards duct 15 that is connected to upper stage burner 12; and a coal particle flow E, which is high in coal concentration and flows towards duct 16 that is connected to lower stage burner 13, and are thus supplied into boiler furnace 8 from upper stage burner 12 and lower stage burner 13, respectively.

By thus installing a damper 11 at the upstream side of branching point 14 of main duct 4 and setting the damper pivoting axis 11*a* above the central part of the damper, the distribution ratios of the carrier gas in the mixed fluid C, which is comprised of coal particles and boiler exhaust gas, can be made the same for branch ducts 15 and 16 and the distribution of just the solid fuel can be changed towards an arbitrary direction (towards branch duct 16 in the first and second embodiments). This is due to the flow of the solid fuel particles being made biased towards just the selected path by inertial force by the installation of damper 11. Thus by adjusting the tilt angle θ of damper 11, the concentration of fuel supplied to the upper and lower stage burners 12 and 13 can be adjusted as suited.

Thus when the boiler load is low, damper 11 can be tilted for example so that a mixed fluid C of high coal particle concentration will be supplied to a burner 13 at the lower stage side of the furnace side wall to secure stability of ignition of coal particles and stable combustion of the ignited flame inside the boiler.

Third Embodiment

Figure 9:
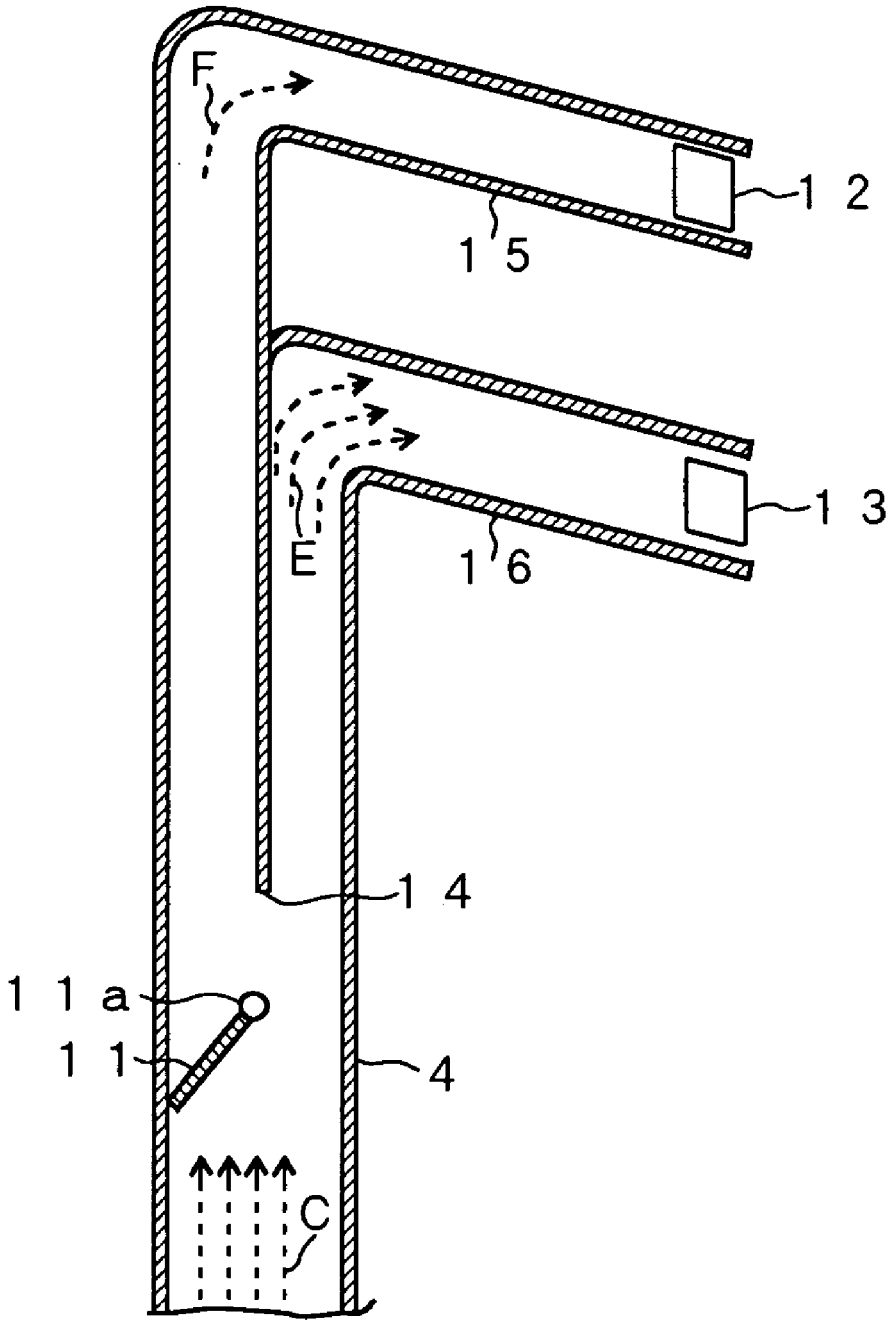
FIG. 9 is a longitudinal sectional view of a fuel supply duct of a third embodiment of this invention.

FIG. 9 shows an example of a fuel supply duct with a rectangular cross section and having a structure wherein branch ducts 15 and 16, which are connected to and branch out from main duct 4 to upper stage burner 12 and lower stage burner 13, respectively, extend in parallel in the upward direction and are separated from each other in the vicinity of upper and lower stage burners 12 and 13. Damper 11 is provided inside main duct 4 forward where it is branched out to upper stage burner 12 and lower stage burner 13.

As shown in FIG. 9, damper 11 has an arrangement wherein its pivoting axis 11*a* is provided at the upstream side of and along a vertical line that passes through branching point 14 and this pivoting axis 11*a* is provided at the upper end part of damper 11. Since as shown in FIG. 9, damper 11 is tilted towards branch duct 15, which leads towards upper stage burner 12, the concentration of coal particles in the mixed fluid E that is supplied to branch duct 16, which leads to lower stage burner 13, becomes higher than the concentration of coal particles in the mixed fluid F that passes through branch duct 15, which leads to upper stage burner 12.

Though the third embodiment provides the same effects as the first embodiment described above, it also provides the following advantage due to the cross section of the fuel supply duct being rectangular.

That is, in terms of structure, restrictors 25 and 26 (FIG. 17), which can change the cross-sectional area of the flow path, can be installed, good operability is provided and localized non-uniform wear is unlikely to occur, etc. since the plates consist only of straight parts, etc.

Fourth Embodiment

This embodiment corresponds to an arrangement wherein a bent, second main duct is connected to the upstream side of vertically-extending main duct 4, having damper 11 installed therein, of the fuel supply duct of the first embodiment described above.

Figure 10:
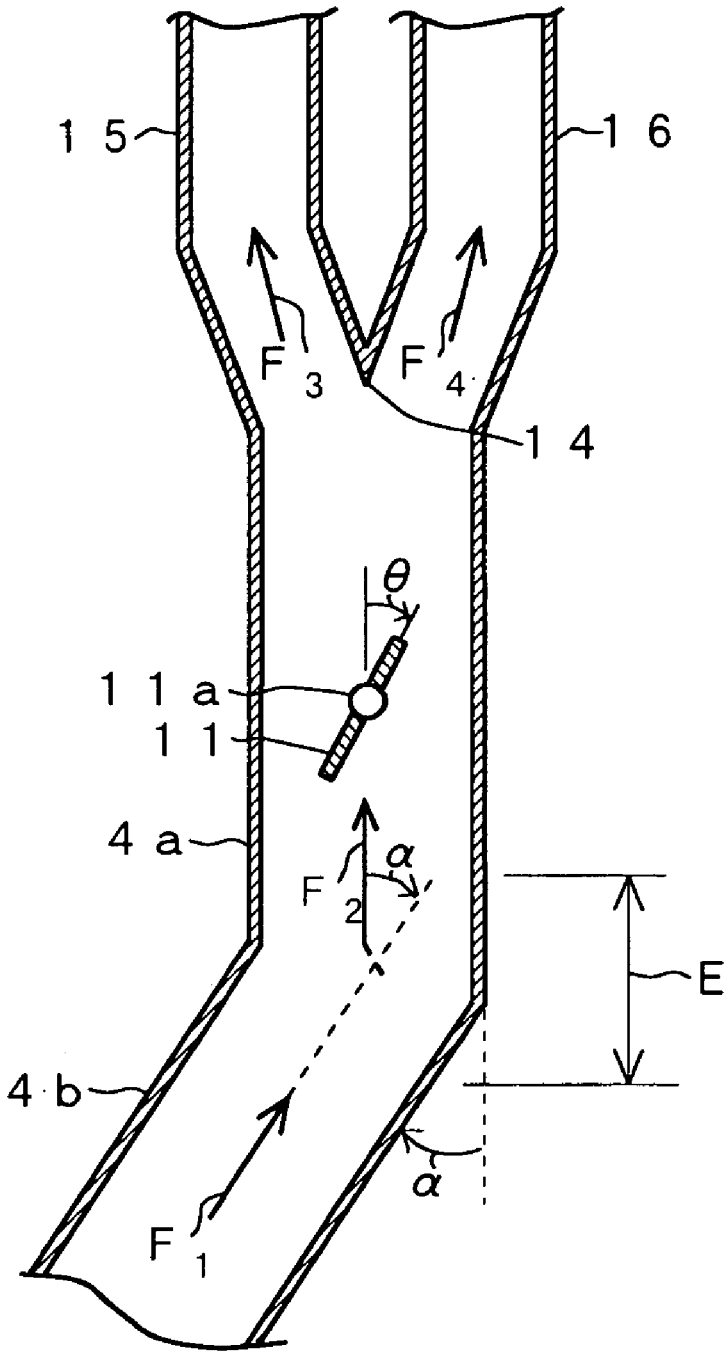
FIG. 10 is a longitudinal sectional view of a fuel supply duct of a fourth embodiment of this invention.

FIG. 10 shows a longitudinal sectional view of the principal parts of the fuel supply duct of this embodiment, and this arrangement is equipped with a main duct 4*a*, having a damper 11 installed therein, damper 11, which is installed at an upstream part in main duct 4*a* in the vicinity of duct branching point 14, and branch ducts 15 and 16, which are connected to an unillustrated upper stage burner and an unillustrated lower stage burner, respectively. Damper 11 is provided with a damper pivoting axis 11*a* that crosses main duct 4*a* in the vicinity of the central part of main duct 4*a*. Damper 11 is arranged to be rotated about pivoting axis 11*a* and be held at an appropriate tilt angle θ.

Though in FIG. 10, pivoting axis 11*a* is disposed at the central part of damper 11, it may be provided at the upper end part of damper 11 as shown in FIG. 2. Likewise with regard to the attachment position of pivoting axis 11*a* to be attached to a damper 11 shown in FIG. 14, 15, or 11, the pivoting axis 11*a* may be provided at the upper end part of damper 11.

Even when for example the tilt angle θ of a damper 11 shown in any of FIG. 1 through FIG. 5 is set so that a mixed fluid of comparatively high coal particle concentration will be supplied to a lower stage burner 13 rather than to an upper stage burner 12, if a biased flow of the solid phase (coal particles) that occurs inside main duct 4 at the upstream side of damper 11 is formed in a manner such that a mixed fluid of comparatively high coal particle concentration will be supplied to upper stage burner 12 rather than to lower stage burner 13 in conflict to what is intended by the setting of the tilt angle θ of damper 11, the effect of installing the above-mentioned damper 11 is lost.

Thus with the present embodiment, the characteristic that the solid phase (coal particles) will flow in a biased manner is enhanced inside a main duct 4*b* at the upstream side of main duct 4*a*, in which damper 11 is installed, to further ensure the biased flow effect of damper 11. A mixed fluid of comparatively high coal particle concentration can thus be supplied to a lower stage burner, which is reached via branch duct 16, rather than to an upper stage burner, which is reached via branch duct 15.

The distributor for a fuel supply duct of the embodiment shown in FIG. 10 is largely arranged from four parts. In terms of structure, this embodiment is characterized in that an elbow (bent part) E is provided between a main duct 4*a*, in which damper 11 is installed, and a main duct 4*b* at the upstream side.

The most downstream part of main duct 4*a* branches into two and is provided with branch duct 15, which is connected to the upper stage burner, and branch duct 16, which is connected to the lower stage burner, and damper 11 and its pivoting axis 11*a* are provided in front of the branching point 14. Pivoting axis 11*a* is provided in the direction of main duct 4*a*.

Damper 11 can be varied in the tilt angle θ about pivoting axis 11*a*. If the clockwise direction is the positive angle direction, by setting tilt angle θ in the range of $0<\theta<90°$, the mixed fluid (solid-gas two-phase flow) that is supplied from the upstream side is bent by damper 11 and is induced to flow more towards the lower stage burner via branch duct 16. That is, the flow volume of mixed fluid in branch duct 16 increases. Since the solid phase is higher in density and stronger in inertial force than the gas phase, the rate of increase of the flow volume at duct 16 will be greater for the solid phase than for the gas phase. As a result, the solid phase flow volume at branch duct 16 increases, and at the same time, the solid phase concentration (concentration of coal particles in the mixed fluid) increases at branch duct 16.

When the tilt angle θ of damper 11 is set in the range of $-90°<\theta<0$, the phenomenon opposite that described above, which occurs when the tilt angle θ is set in the range of $0<\theta<90°$, takes place and the solid phase flow volume and solid phase concentration at branch duct 15 increases.

A characteristic of damper 11 in the distributor for a fuel supply duct of this embodiment is that since an axially asymmetric inertial classification type damper 11 is used purposely, the coal particle concentration in the direction of the cross section of main duct 4*a*, in which damper 11 is installed, increases substantially monotonously towards the downstream side of the duct.

The respective vectors in the flow direction (principal axis direction) F1 of the mixed fluid in main duct 4*b* at the upstream side of elbow E, in the principal axis direction F2 of main duct 4*a* at the downstream side of elbow E, in the principal axis direction F3 of the entrance part of branch duct 15, which is connected to the upper stage burner, and in principal axis direction F4 of the entrance part of branch duct 16, which is connected to the lower stage burner, are set within the same plane. Damper pivoting axis 11*a* is set in the direction perpendicular to the above-mentioned plane.

With this embodiment's distributor for a fuel supply duct that satisfies the above conditions, when the damper tilt angle θ is set in the positive direction in the range of $0°<\theta<90°$, the orientation of main duct 4*b* at the upstream side of the damper 11 installed part is set by arranging the angle α (the clockwise direction is the positive direction for α), formed by the principal axis direction F1 and principal axis direction F2, to be in the range of $0<\alpha<180°$ by means elbow E. When this angle α is set in this manner, the mixed fluid (solid-gas two-phase flow) that flows into main duct 4*a* is bent in the negative direction of angle α by elbow E. Since the coal particle solid phase, which is high in density, is high in inertia at this point, biased flow of the mixed fluid occurs and the mixed fluid that has reached the part at which damper 11 is installed is enhanced further in the above-mentioned biased flow by damper 11 so that the concentration and flow volume of coal particles (solid phase) in the mixed fluid that flows towards branch duct 16 increase over that which flows towards branch duct 15. By this orientation, the distributor for fuel supply duct shown in FIG. 10 can provide a distribution performance that is greater than or equal to the distribution capacity, due to damper 11, for the coal particles (solid phase) in the mixed fluid at main duct 4*a* at the damper installed part. That is, a combination effect of elbow E and damper 11 is provided.

From another viewpoint, though generally when the tilt angle θ of damper 11 is made large, the capacity of distributing the coal particles in the mixed fluid is increased, since the passage area of the mixed fluid in duct 4*a* is narrowed, the loss of the mixing fluid carrying pressure provided by fan mill 3 increases. Thus by providing an elbow E in main duct 4*b* at the upstream side of the damper installed part, a coal particle (solid phase) distribution capacity of a level equivalent to those of the embodiments shown in FIG. 1 through FIG. 5 can be achieved at a lower carrying pressure.

Normally with the system shown in FIG. 20 for supplying coal to a boiler furnace 8, the fuel supply duct 4, having fan mill 3 as the most upstream point, is designed to have the shortest route that extends in the vertical direction in order to reduce the pressure loss during carrying of the mixed fluid. However, in many cases, the provision of a bent part within the vertical plane cannot be avoided in positioning the various mixed fluid carrying equipment. By setting elbow E of tilt angle α at main duct 4*b* at the upstream side of the damper installed part as such a bent part, the pressure loss of the mixed fluid carrying system that arises anew as a result of the above-mentioned tilt angle α does not have to be calculated into the pressure loss of the entire mixed fluid carrying system. That is, the pressure loss that inherently occurs at a bent part can be used effectively to improve the distribution performance. The distribution performance can thus be improved without increase of pressure loss.

Also, when the above-mentioned tilt angle α is set in the vicinity of 90° (when a horizontal part is provided in the main duct 4*b* part at the upstream side of the damper installed part), the effect of gravity that acts on the solid phase in main duct 4*b* is maximized. Since a thick solid phase will thus tend to form readily at the bottom part of main duct 4*b*, the distribution performance of dividing the mixed fluid in the entire distributor for fuel supply duct into a region with a higher concentration of coal particles (solid phase) and a higher concentration of carrier gas (gas phase) can be improved maximally. Furthermore, by setting the duct arrangement of the above-described bent part, wherein main duct 4 is provided with a tilt angle α, in the vicinity of the exit of fan mill 3, there will be no need to set a bent part anew in main duct 4*b* at the upstream side of the damper installed part.

Figure 11:
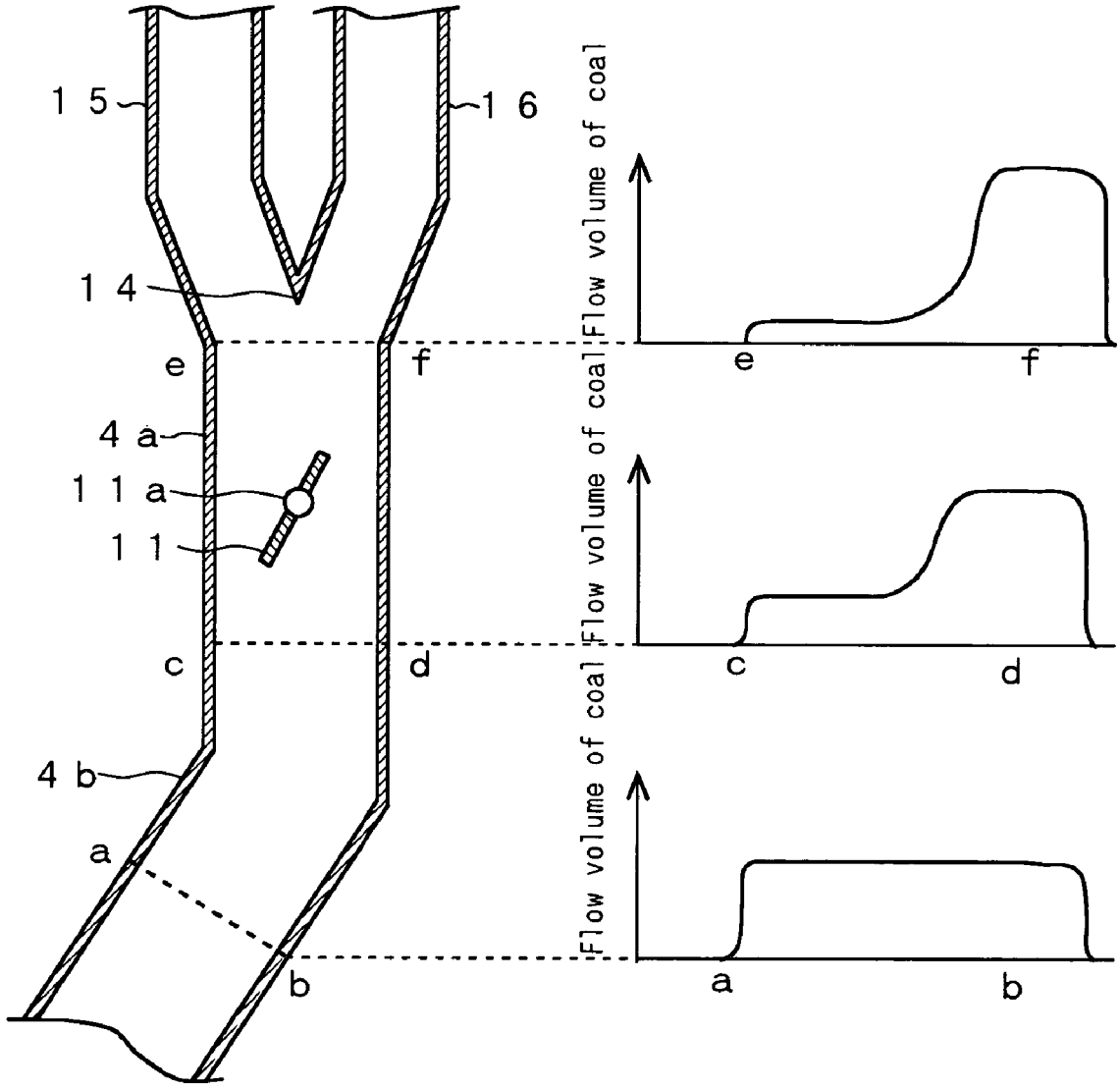
FIG. 11 is a diagram, which explains the manner in which the coal flow deviation increases in the fuel supply duct of the fourth embodiment of this invention.
Figure 12:
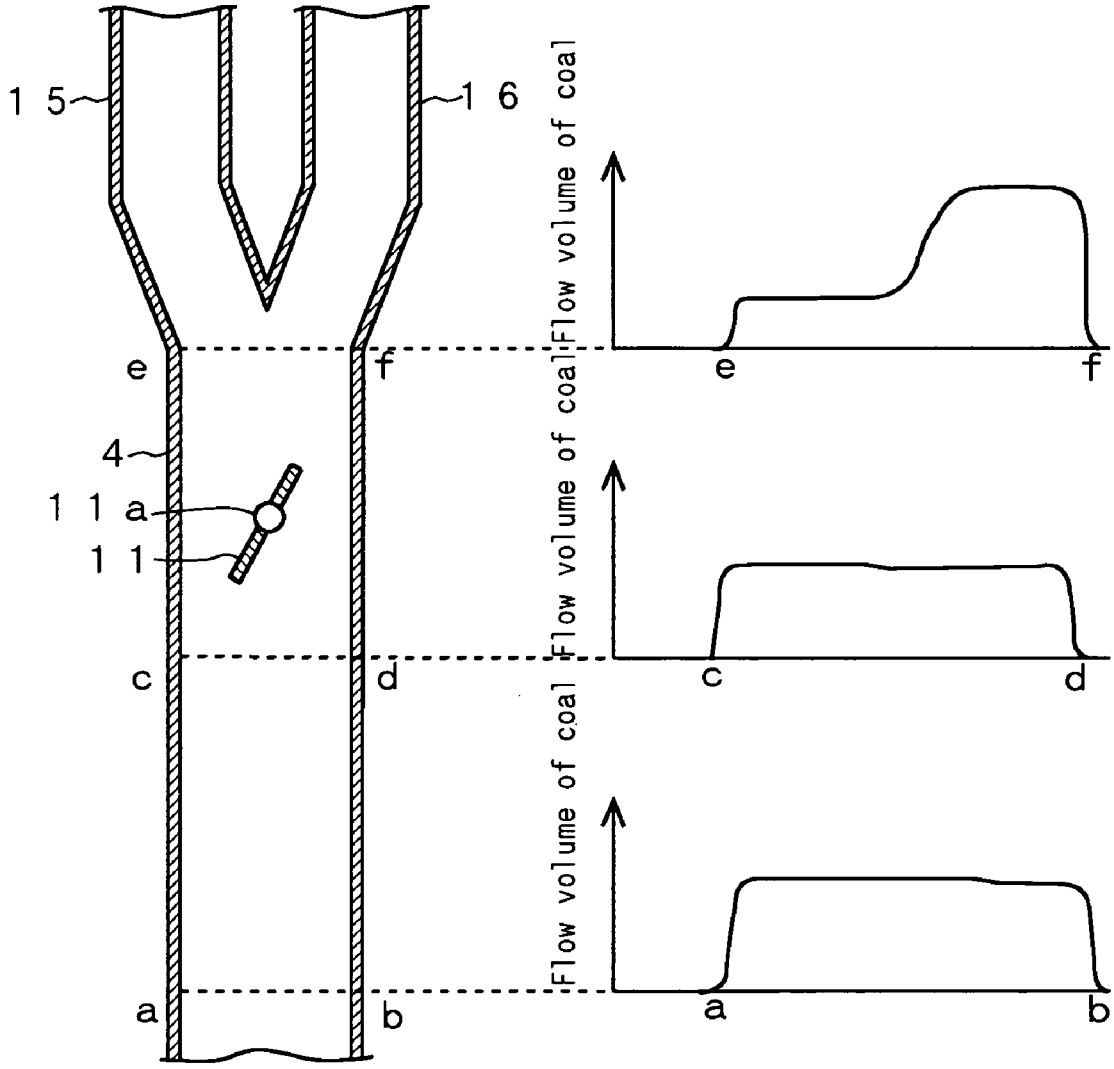
FIG. 12 is a diagram, which explains the manner in which the coal flow deviation increases in the fuel supply duct of the first embodiment of this invention.

The major effects of this embodiment are shown in FIG. 11. These shall be described by comparison with the characteristics of the first embodiment that are shown in FIG. 12.

The three graphs that are shown at the right side of the figure are graphs of the coal flow volume distributions at the cross section a-b in main duct 4*b*, the cross section c-d at the downstream side of the bent part of elbow E, and the cross section e-f in front of the branching point 14 of main duct 4*a*. The flow of mixed fluid, which exhibits a substantially uniform flow volume distribution at cross section a-b in main duct 4*b*, comes to exhibit a higher value at the right side of the coal flow volume distribution diagram at the cross section c-d at the downstream side of the bent part of elbow E. Meanwhile, with the arrangement of FIG. 1, a uniform flow volume distribution is maintained at the same position (FIG. 12). Given the above distribution condition, the coal flow volume is made even more non-uniform by damper 11 with the example shown in FIG. 11, and thus a high value is indicated at the right side in the coal flow volume distribution at cross section e-f in main duct 4*a* at the downstream side of the damper. Since this coal flow volume distribution is directly reflected in branch duct 15 and branch duct 16, the coal flow volume in branch duct 16 is significantly increased with the present embodiment in comparison to the first embodiment shown in FIG. 1.

Figure 13:
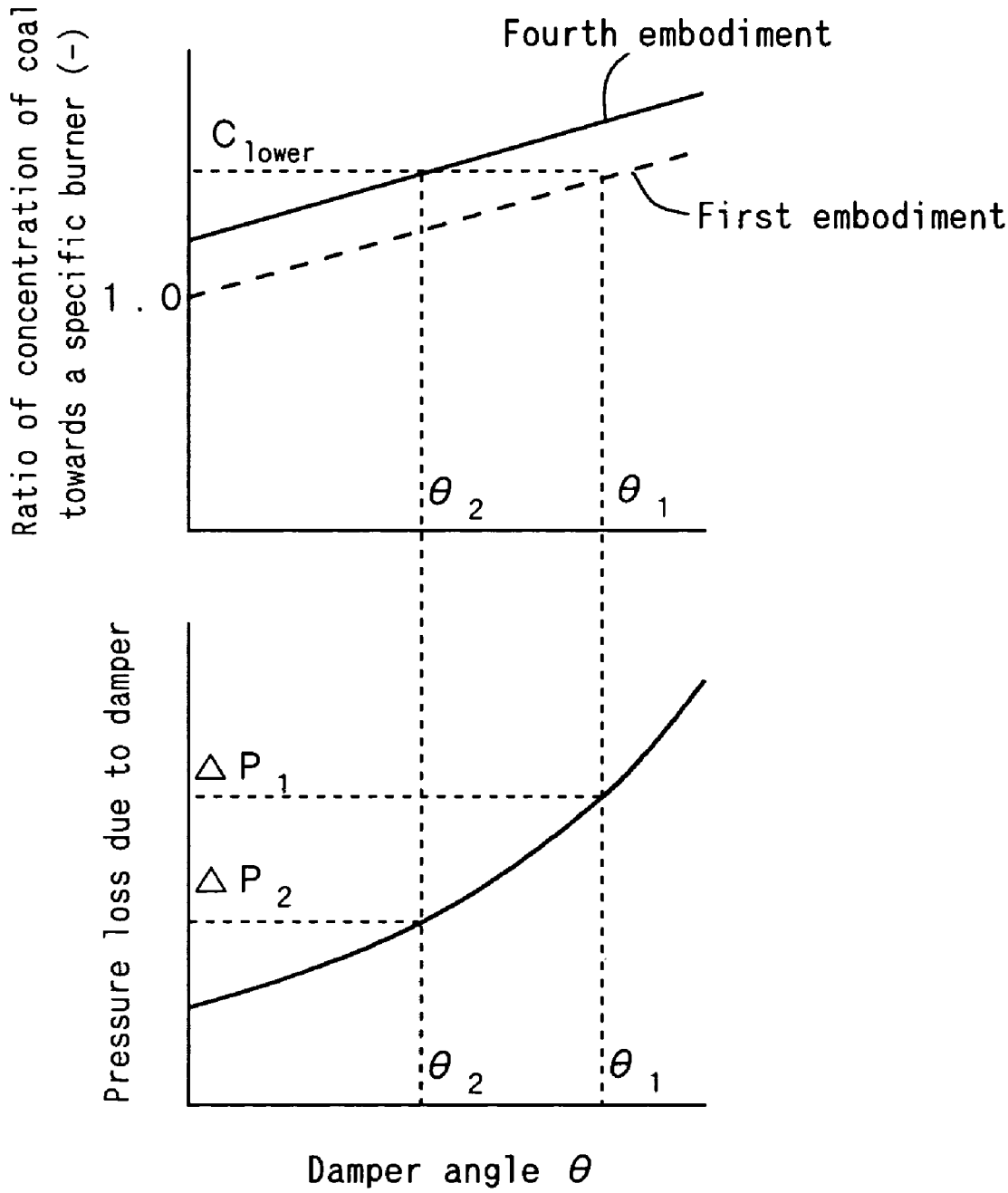
FIG. 13 is a diagram, which explains the coal flow increasing and pressure loss decreasing effects at a lower stage burner in the cases where the fuel supply ducts of the first embodiment and fourth embodiment of this invention are used.

The second effect of this embodiment is illustrated in FIG. 13.

When the damper tilt angle θ is set to a large value, the ratio of concentration of coal that is supplied to a specific burner (the lower stage burner in the present embodiment) (=flow volume of coal supplied to branch duct 16) increases. With the present embodiment (solid line), the above-mentioned coal concentration ratio is increased over that of the first embodiment (broken line). If the ratio of concentration of coal towards the lower stage burner is kept at the same value $C_{lower}$ with the present embodiment and the first embodiment, the tilt angle θ of duct 11 can be lowered from angle $\theta_1$ to angle $\theta_2$.

The effect of the damper tilt angle θ on the pressure loss in main duct 4 at the damper installed position will be a downwardly convex curve as shown in the lower diagram in FIG. 13. With the present embodiment, since the angle $\theta_1$ can be lowered to angle $\theta_2$, the pressure loss $\Delta P_1$ at the damper 11 installed part can be lowered to $\Delta P_2$.

Fifth Embodiment

Figure 14:
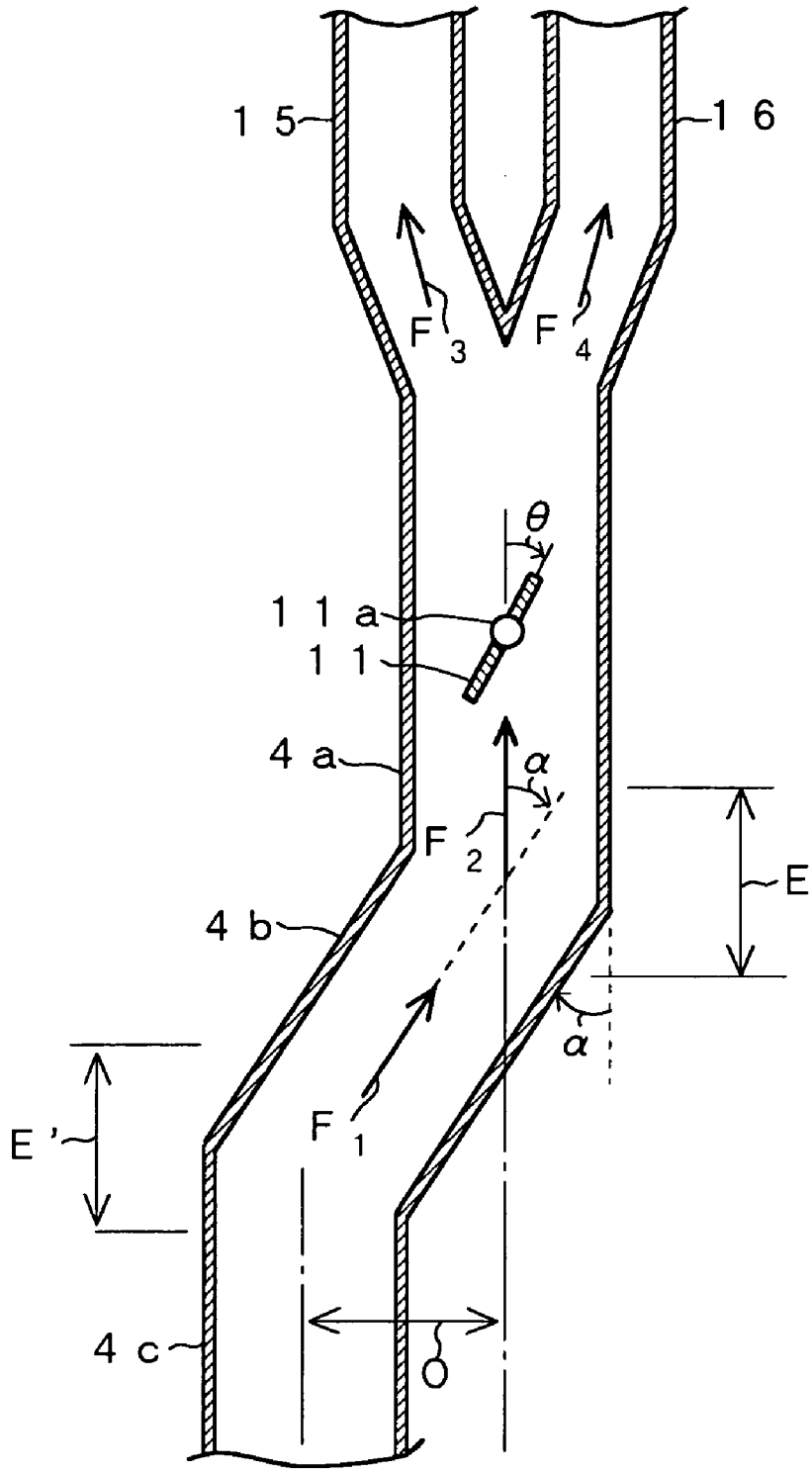
FIG. 14 is a longitudinal sectional view of a fuel supply duct of a fifth embodiment of this invention.

The distributor for fuel supply duct of the embodiment shown in FIG. 14 is a distributor for fuel supply duct that is a modification of the embodiment shown in FIG. 10. With this device, main duct 4 is provided with a main duct 4*a*, which is oriented in the vertical direction of the damper installed part, a duct 4*b*, which is oriented in a bent manner and connected to the upstream side of main duct 4*a* via an elbow E, and a vertically oriented duct 4*c*, which is provided via elbow E', that is, the elbows E and E' are provided at two locations, i.e. an upper location and a lower location, of main duct 4, and furthermore, an offset O is set between the principal axes of the vertical duct 4*a* and duct 4*c*.

The structures of the other parts of the distributor for fuel supply duct shown in FIG. 14 are the same as the structures shown in FIG. 10. Due to the above-mentioned offset O, the mixed fluid that has passed through main duct 4*c* collides with the upper part of the wall of duct 4*b*. The mixed fluid, comprised of a solid-gas two-phase flow, is thus changed in the direction of flow by the upper part of the wall of main duct 4*b* and upon reaching damper 11 in main duct 4*a*, is changed further in the direction of flow in the opposite direction by the tilt angle α. Due to its inertia, the solid phase flow in the mixed fluid flows toward the wall of main duct 4*a* that is closer to the branch duct 16, which is connected to the lower stage burner. Thus in a manner similar to the effect described with FIG. 10, the concentration and flow volume of the coal particles (solid phase) in the mixed fluid that flows towards branch duct 16 that is connected to the lower stage burner increases in comparison to those of the mixed fluid that flows towards branch duct 15 that is connected to the upper stage burner.

The distributor for a fuel supply duct of this embodiment can be arranged by a simple orientation by shifting fan mill 3 in position with respect to main duct 4*a* by the same amount as the above-mentioned offset O.

Sixth Embodiment

Figure 15:
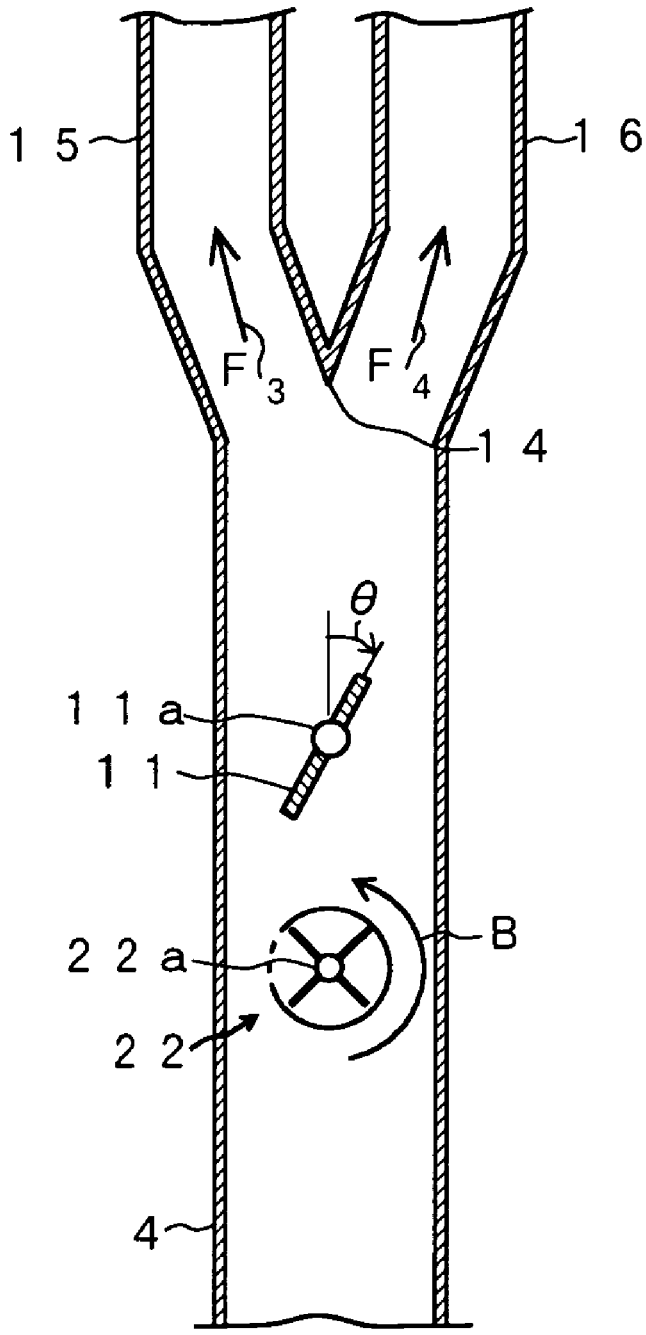
FIG. 15 is a longitudinal sectional view of a fuel supply duct of a sixth embodiment of this invention.

The embodiment shown in FIG. 15 is also a distributor for a fuel supply duct that is a modification of the embodiment shown in FIG. 10. With this distributor, main duct 4 is provided with branch ducts 15 and 16, which branch out and connect to an unillustrated upper stage burner and lower stage burner, respectively, a damper 11, which rotates about damper pivoting axis 11*a* is provided at the upstream side near branching point 14, and a rotating vane 22, with a rotating axis 22*a*, is disposed further upstream damper 11. Damper pivoting axis 11*a* and rotating axis 22*a* are disposed in the direction orthogonal to the principal axis of main duct 4. The damper pivoting axis 11*a* may be provided at the upper end part of damper 11 as shown in FIG. 2.

The distributor for fuel supply duct shown in FIG. 15 corresponds to an arrangement wherein the distributor for fuel supply duct of the embodiment shown in FIG. 4 is additionally provided with rotating vane 22 and rotating axis 22*a*.

By applying rotation in the direction of arrow B to rotating vane 22 when the tilt angle θ of damper 11 is such that $0°<\theta<90°$, the coal particles that have flowed into the region in which rotating vane 22 is installed will act to promote the flow of the solid-gas two-phase flow at the main duct 4 side (the right side in FIG. 15) that is closer to branch duct 16 and impede the flow at the main duct 4 side (the left side in FIG. 15) that is closer to branch duct 15 of central axis 21*a*. As a result, the concentration of coal particles in the mixed fluid in main duct 4 at the vicinity of the part at which damper 11 was installed will be high at the main duct 4 side that is closer to branch duct 16 and be low at the main duct 4 side that is closer to branch duct 15. Thus as in the case of the fourth embodiment shown in FIG. 10 and the fifth embodiment shown in FIG. 14, the effect of increasing the concentration and flow volume of coal particles in the mixed fluid that flows towards branch duct 16 that is connected to the lower stage burner in comparison to those of the mixed fluid that flows towards branch duct 15 that is connected to the upper stage burner is provided.

The effects unique to the present embodiment are that there is no need to bend main duct 4 and that when the tilt angle θ of damper 11 is such that $-90°<\theta<0$, the increase of the concentration and flow volume of coal particles in the mixed fluid that flows towards branch duct 15 in comparison to those of the mixed fluid that flows towards branch duct 16 can be realized readily by setting the direction of rotation of rotating vane 22 in the direction opposite the direction of the arrow B.

Also with the present embodiment, since strong, mechanical rotation can be applied to the flow of the solid-gas two-phase flow by means of rotating vane 22, even when there is a biased flow in main duct 4 at the upstream side of rotating vane 22, this biased flow can be corrected more forcibly in comparison to the above-described fourth embodiment and fifth embodiment.

With the fourth embodiment and fifth embodiment, since a bent part E and/or E' is or are set, the pressure loss is increased in comparison to the case where main duct 4 is a straight tube. However, since the cross sectional area of the flow path of main duct 4 is not reduced, the lowering of pressure loss at the damper 11 installed part is significantly greater than the increase of pressure loss due to the provision of a bent part. That is, since a biased flow is already intentionally formed at the upstream side of damper 11, the angle θ of the damper 11 part can be set that much smaller and the pressure loss due to damper 11 can thus be reduced significantly. With the present embodiment, though the cross sectional area of the flow path of main duct 4 is reduced statically, there is hardly no pressure loss at the rotating vane 22 installed part since the rotating speed of rotating vane 22 can be set to be greater than the flow velocity of the mixed fluid.

Seventh Embodiment and Eighth Embodiment

Figure 16:
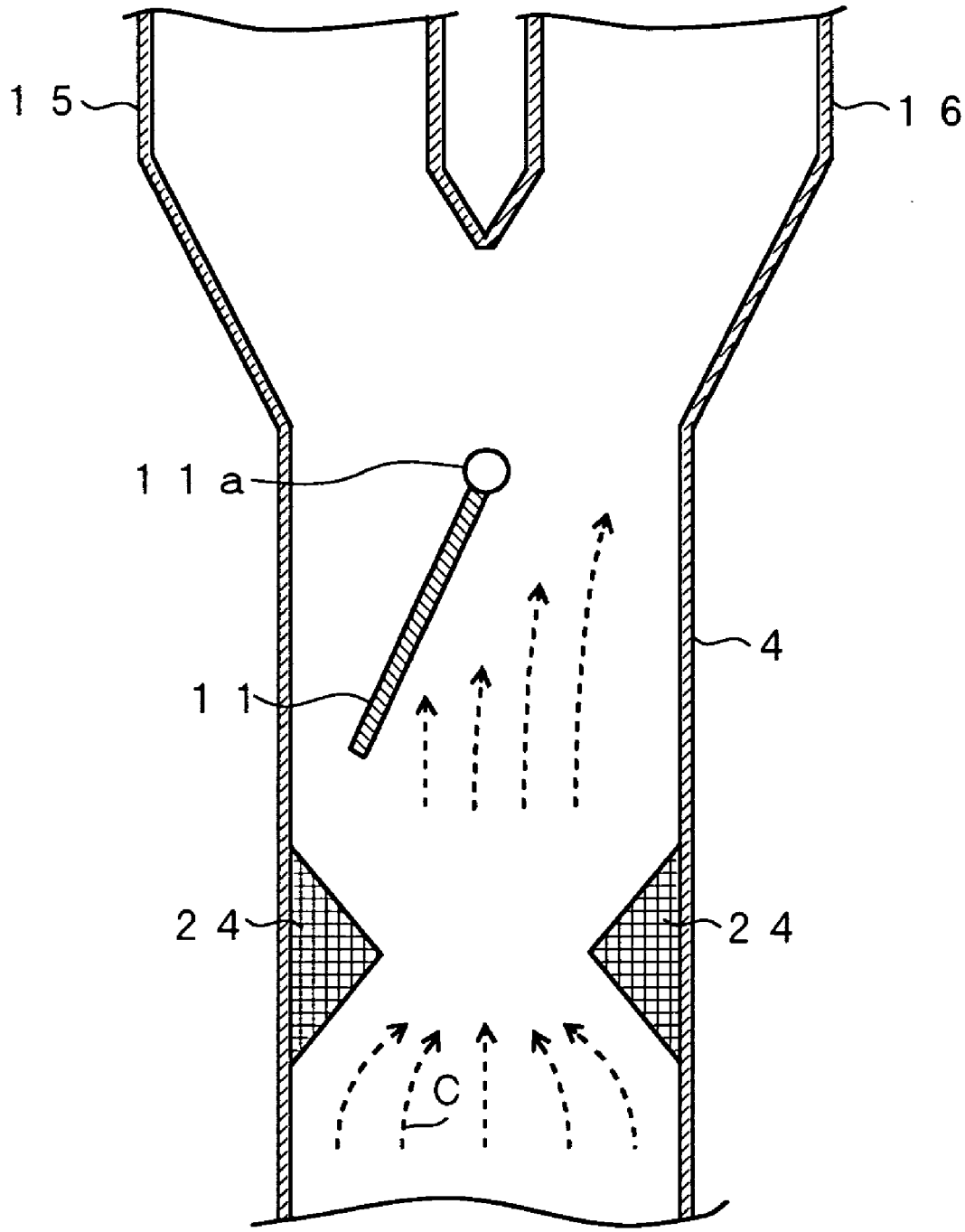
FIG. 16 is a longitudinal sectional view of a fuel supply duct of a seventh embodiment of this invention.
Figure 17:
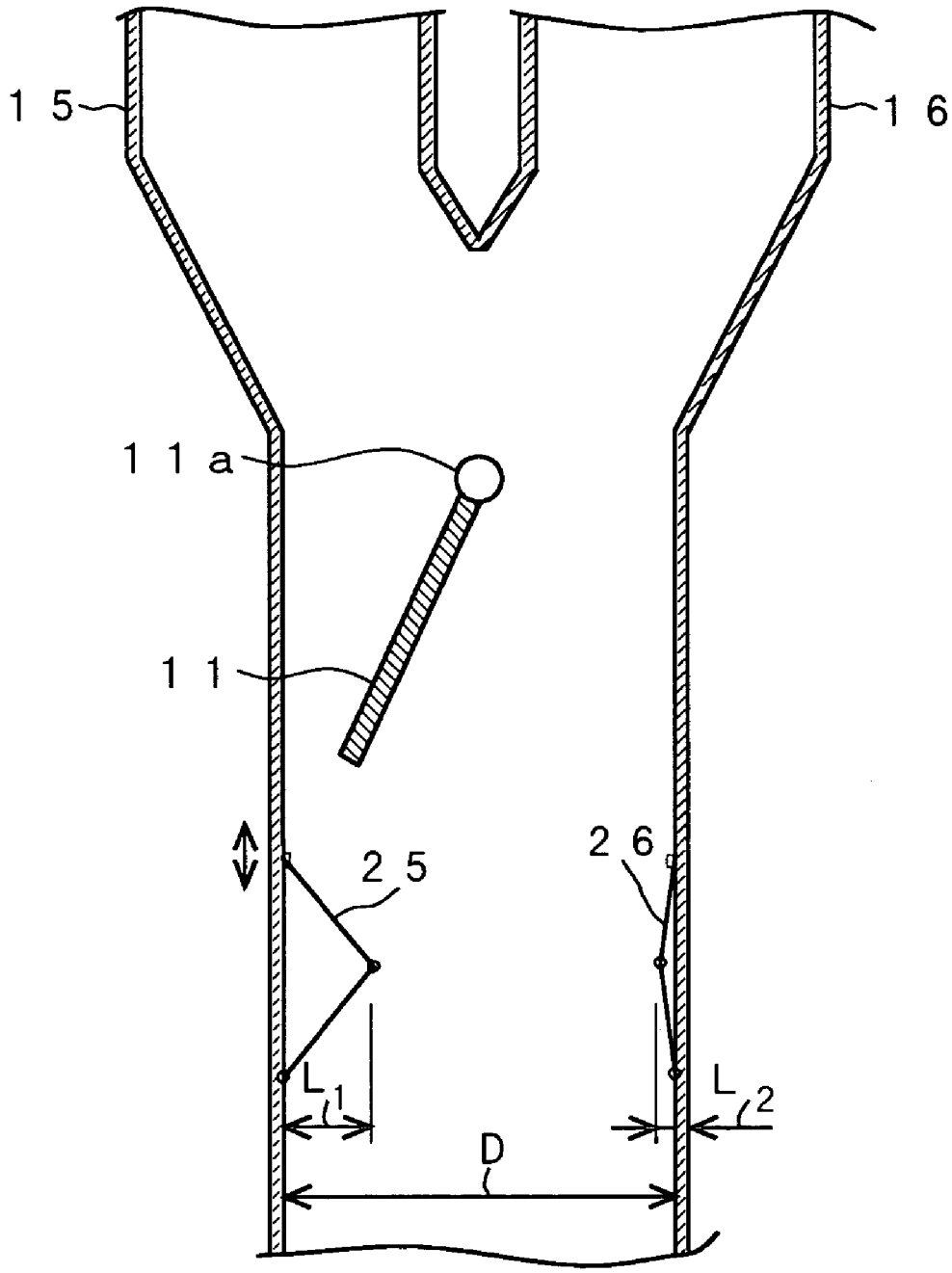
FIG. 17 is a longitudinal sectional view of a fuel supply duct of an eighth embodiment of this invention.
Figure 18:
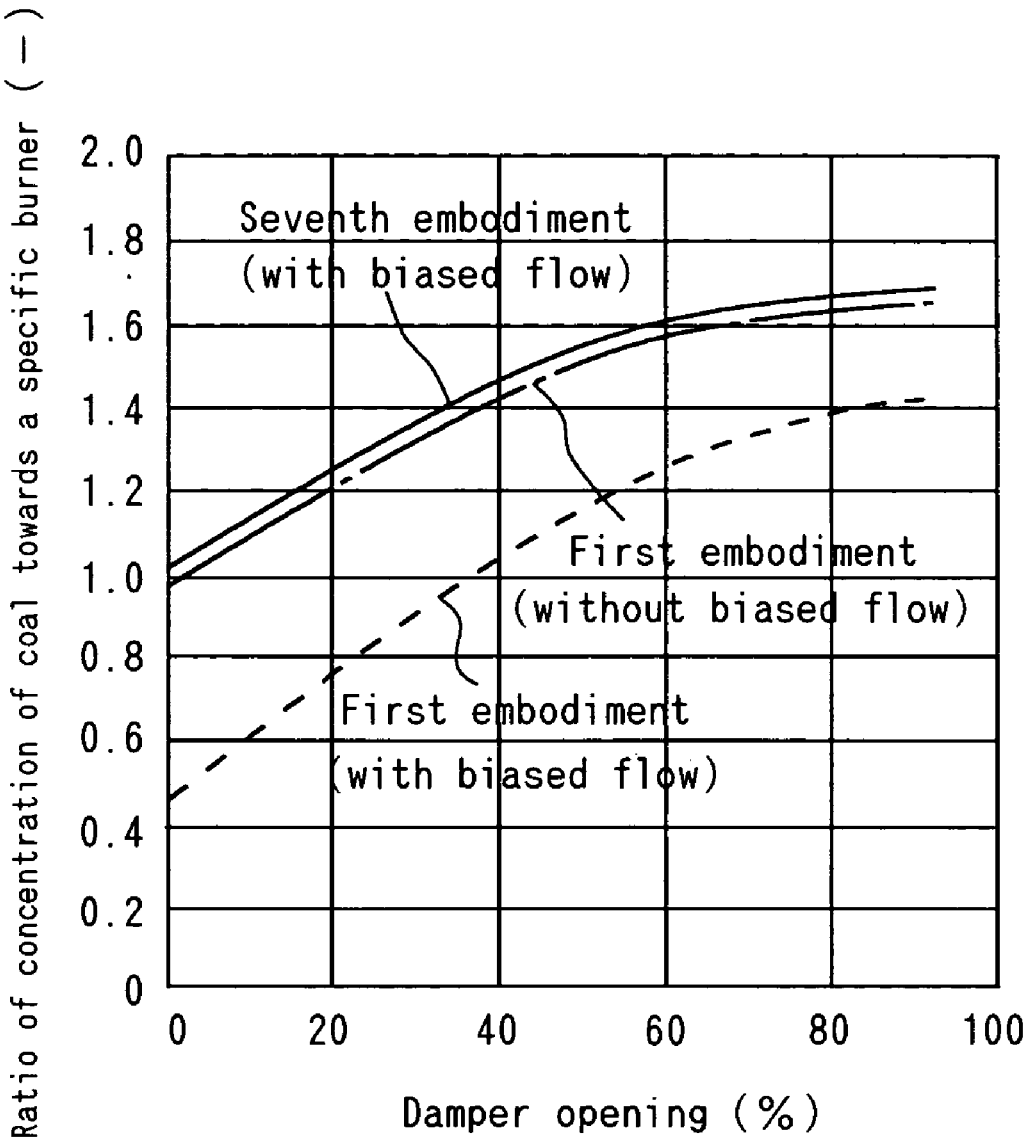
FIG. 18 is a diagram, which illustrates the performance of distribution of coal particles at a lower stage burner by the seventh embodiment and the first embodiment of this invention.

FIG. 16 is a longitudinal sectional view of the principal parts of the distributor for a fuel supply duct of the seventh embodiment of this invention. FIG. 17 is longitudinal sectional view of the principal parts of the distributor for a fuel supply duct of the eighth embodiment, which is a modification of the embodiment shown in FIG. 16. FIG. 18 is a diagram that illustrates the distribution performance of the distributor of FIG. 16.

Figure 21:
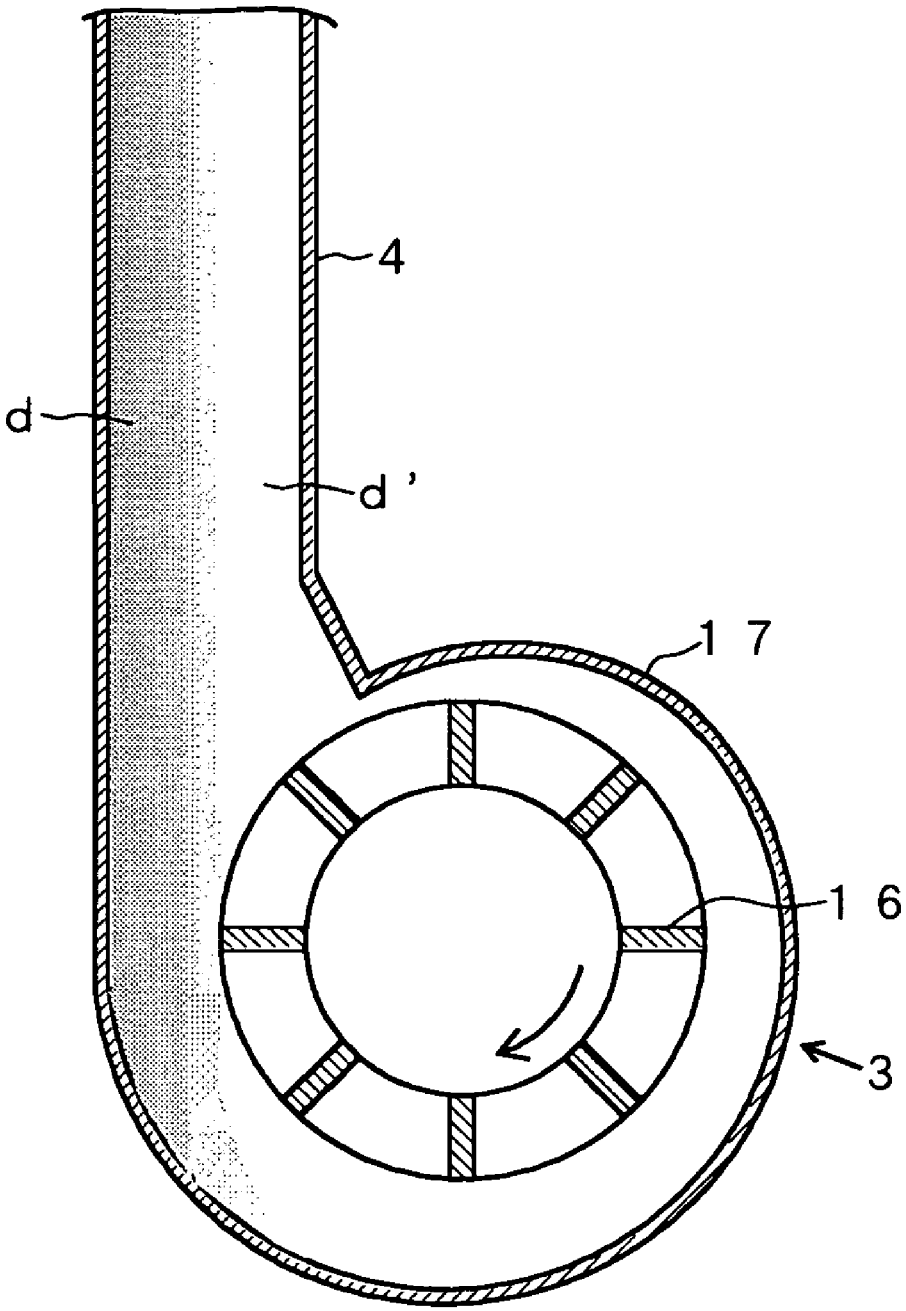
FIG. 21 is a diagram, which shows the flow conditions of coal in the fan mill shown in FIG. 20.
Figure 22:
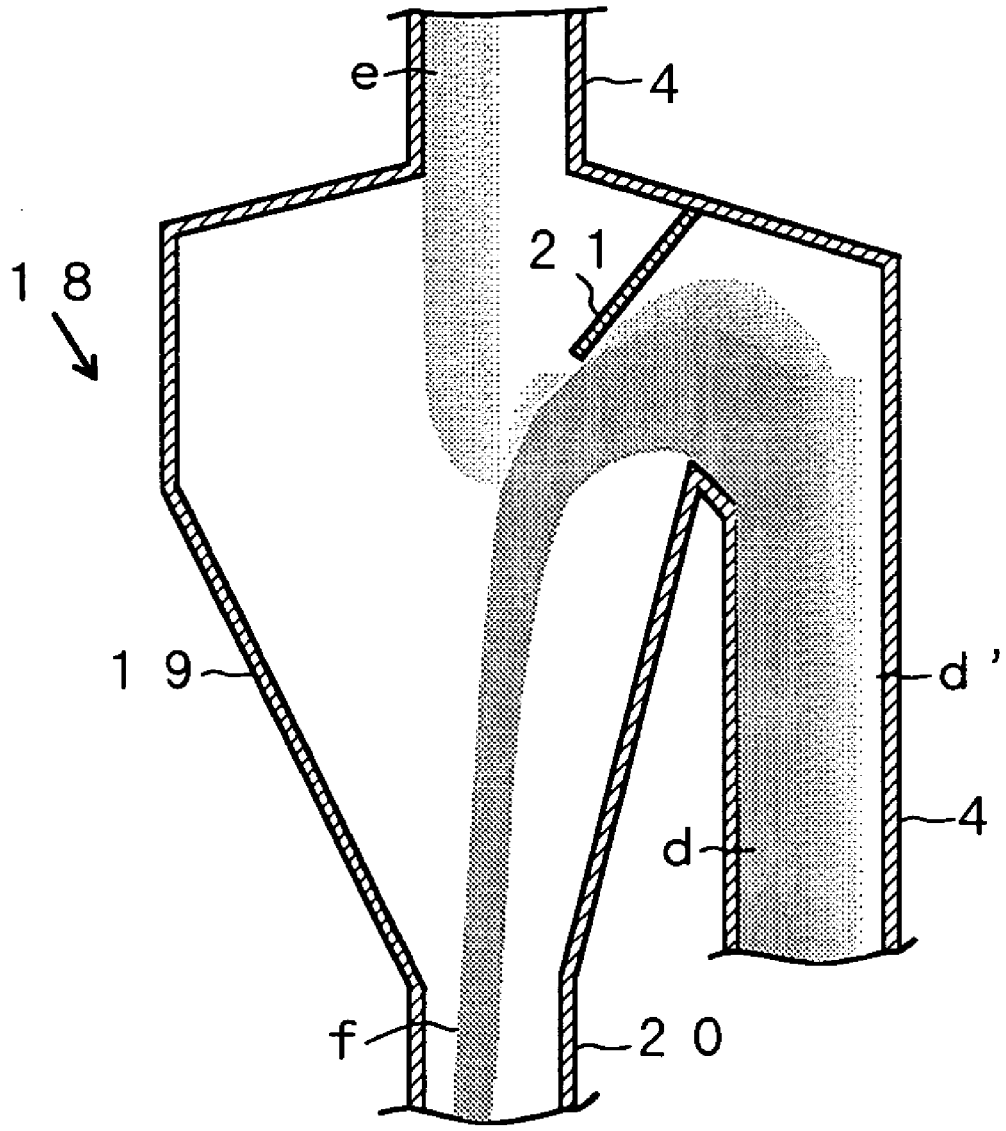
FIG. 22 is a partial longitudinal sectional view of a classifier, which shows the flow conditions of coal in the case where a classifier is installed in the fuel supply duct shown in FIG. 20.
Figure 23:
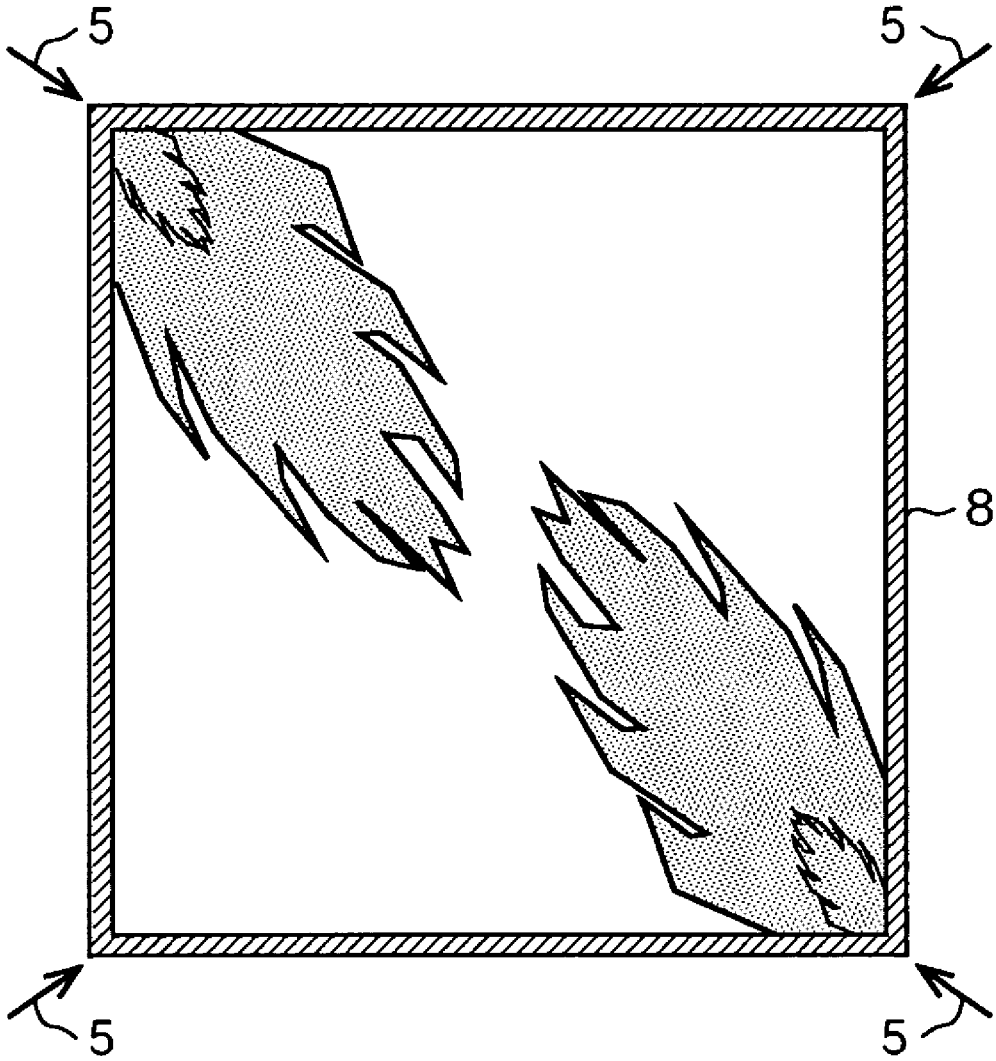
FIG. 23 is a horizontal sectional view of the interior of a furnace during stable combustion when the load is low.

As has been described with reference to FIG. 21 and FIG. 22, the coal particles that are carried by fan blade 17 of fan mill 3 and via classifier 18 give rise to a bias in the solid-gas two-phase flow in main duct 4 and a high-concentration coal flow d or a high-concentration coal flow e may form with respect to the cross-sectional direction of the duct in the solid-gas two-phase flow.

Figure 19:
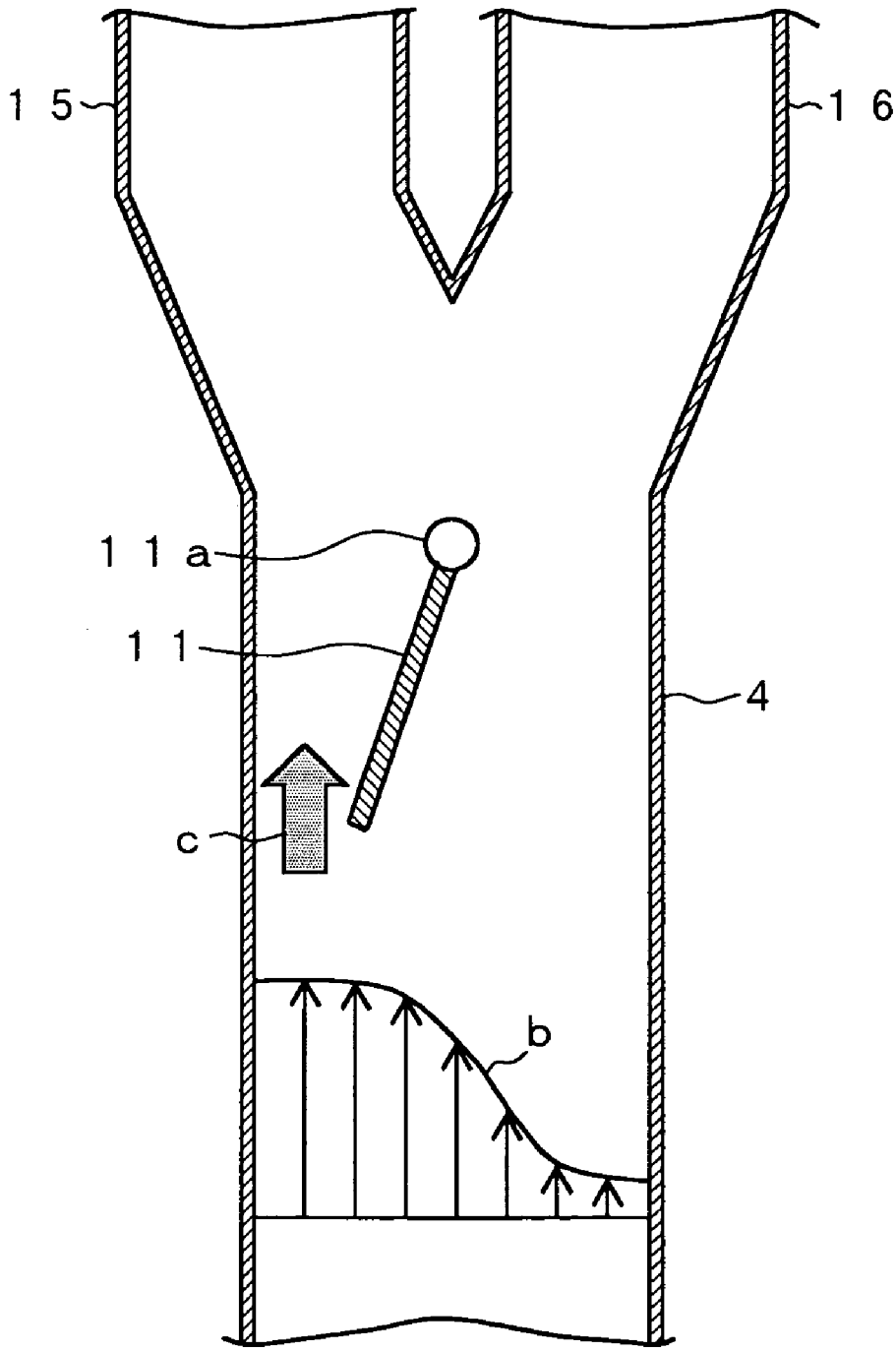
FIG. 19 is a longitudinal sectional view of a fuel supply duct for explanation of the problem that may occur with the first embodiment of this invention.

In such a case, as shown in FIG. 19, if for example a damper is disposed inside main duct 4 in a tilting manner in the direction of guiding the coal to branch duct 16, which leads to the lower stage burner. The mixed fluid is biased so that the coal concentration distribution b in the cross-sectional direction at the main duct 4 at the upstream side of the damper 11 will be such that the coal concentration increases from the central part of the duct 4 towards the branch duct 15 for the upper stage burner. The high-concentration coal flow c, which passes through the space between the lower end part of damper 11 and the wall of main duct 4 without colliding with damper 11, increases and the flow volume of coal that flows into branch duct 15 for the upper stage burner increases.

FIG. 18 shows the relationship between the opening of main duct 4 in the cross-sectional direction by damper 11 and the ratio of concentration of coal particles (towards the branch duct 16 that leads to the lower stage burner). With the arrangement shown in FIG. 19, the ratio of concentration of coal particles towards branch duct 16 that leads to the lower stage burner in the case where there is a biased flow of coal particles in the main duct 4 at the upstream side of the part at which damper 11 is installed (broken curve) may be lower in comparison to that in the case where there is no biased flow (alternate long and short dash line).

As a countermeasure for the above-described problem of the first embodiment illustrated in FIG. 19, a distributor for fuel supply duct of the arrangement shown in FIG. 16 was employed in the seventh embodiment.

The seventh embodiment has an arrangement wherein an annular restriction member 24 is provided on the inner wall of the main duct 4 that extends in the vertical direction, a damper 11, equipped with a pivoting axis 11*a* is provided at the downstream part of restriction member 24, and branch ducts 15 and 16, which branch out and connect to an unillustrated upper stage burner and lower stage burner, respectively, are provided downstream the main duct 4 in which damper 11 is installed.

By the above-mentioned restriction member 24, the flow of mixed fluid C, comprised of a solid-gas two-phase flow, is converged once towards the principal axis and is then dispersed after passage through restriction member 24. The coal particle concentration distribution in the direction of the cross section of main duct 4 thus becomes uniform once in passing through restriction member 24 and thereafter, a mixed fluid that is high in coal particle concentration at the branch duct 16 side flows.

Thus even if the solid-gas two-phase flow is biased towards branch duct 15 for the upper stage burner in main duct 4, since the amount of coal that passes through the space between the lower end part of damper 11 and the wall of main duct 4 shown in FIG. 19 decreases, a good distribution characteristic can be obtained.

FIG. 18 shows the performance of distribution of coal particles towards branch duct 16 that leads towards the lower stage burner of the arrangement shown in FIG. 16.

With the present embodiment, even when there is a biased flow in the mixed fluid in main duct 4 at the upstream side of the part at which damper 11 is installed, since restrictor 24 is provided, the lowering of the ratio of concentration of coal particles towards branch duct 16 that leads to the lower stage burner does not occur and good distribution performance, equivalent to that in the case where there is no biased flow in the flow, can be obtained.

The eighth embodiment shown in FIG. 17 is a modification of the device shown in FIG. 16, and with this embodiment, a pair of restriction members 25 and 26, which can be adjusted in the height in the direction of the cross section of main duct 4, are provided on the inner walls of main duct 4 at the upstream side of the damper 11 installed part provided in main duct 4, which has a rectangular cross section. In the case where, for example, coal particles are to be supplied in a concentrated manner to branch duct 16 for the lower stage burner, since the concentration of coal particles that pass towards the branch duct 15 for the upper stage burner should be decreased at the damper 11 installed part, the height $L_1$ of the height-adjustable restriction member 25 installed at the side of branch duct 15 for the upper stage burner is made high and the height $L_2$ of the height-adjustable restriction member 26 installed at the side of branch duct 16 for the opposite lower stage burner is made most low as shown in FIG. 17.

Unnecessary increase of pressure loss within main duct 4 can thus be avoided. Also, it is preferable for the heights $L_1$ and $L_2$ of restriction members 25 and 26 to be adjustable with respect to the inner diameter D of the duct within the ranges of $0 \leqq L_1/D \leqq 0.3$ and $0 \leqq L_2/D \leqq 0.3$.

Ninth Embodiment and Tenth Embodiment

Figure 24:
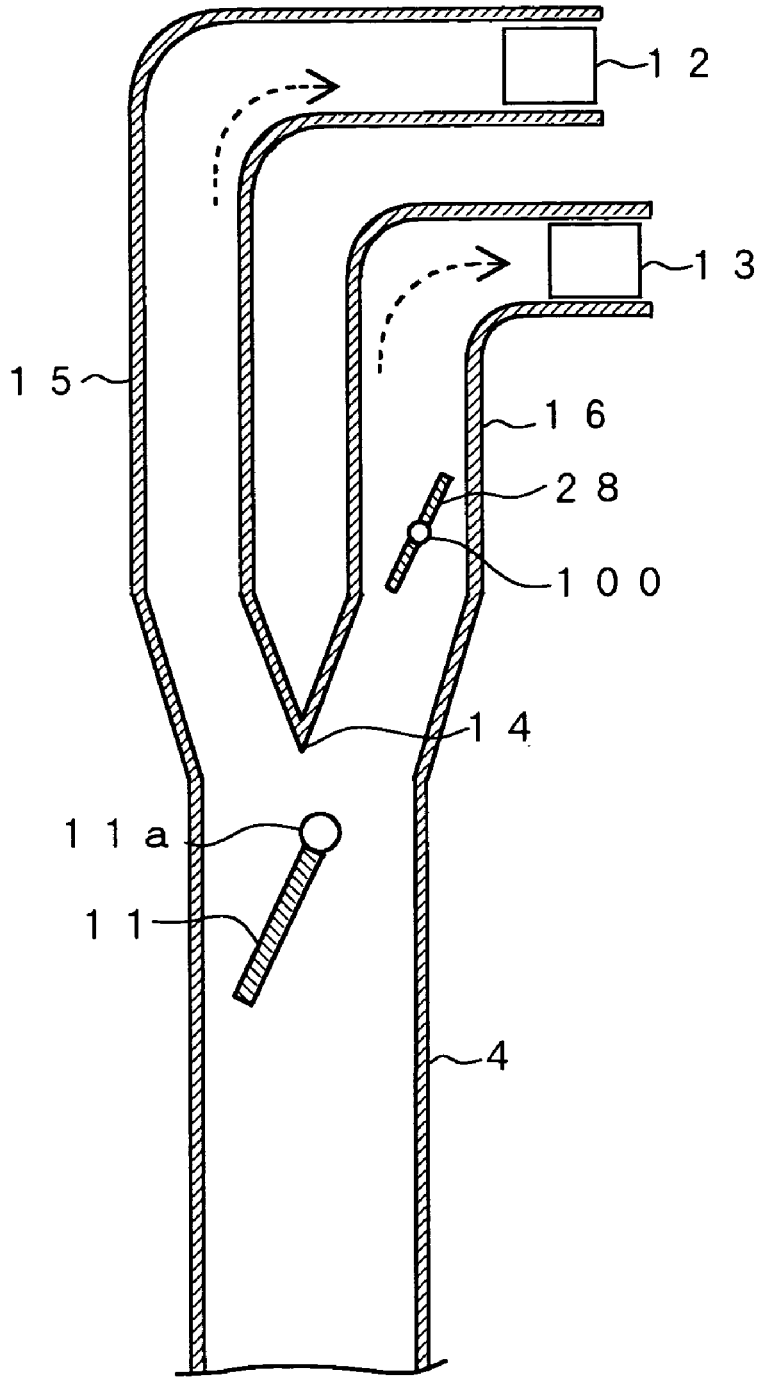
FIG. 24 is a longitudinal sectional view of a fuel supply duct of a ninth embodiment of this invention.
Figure 25:
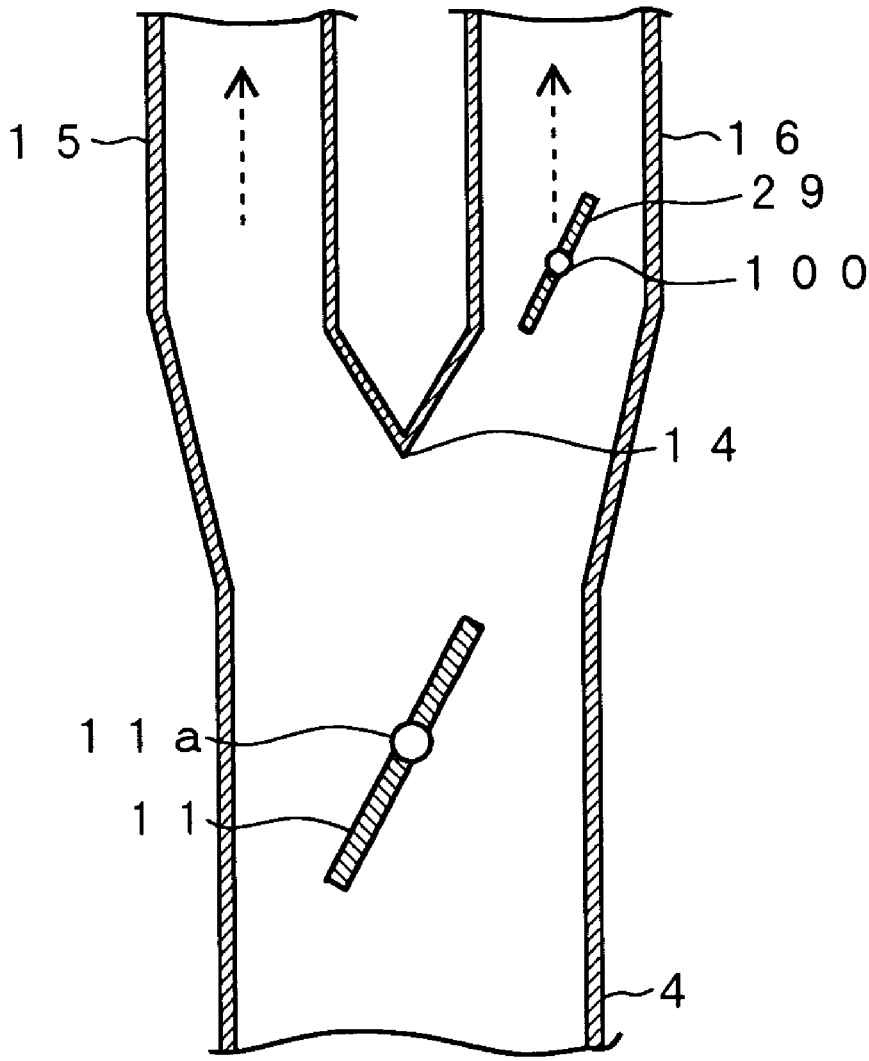
FIG. 25 is a longitudinal sectional view of a fuel supply duct of a tenth embodiment of this invention.
Figure 26:
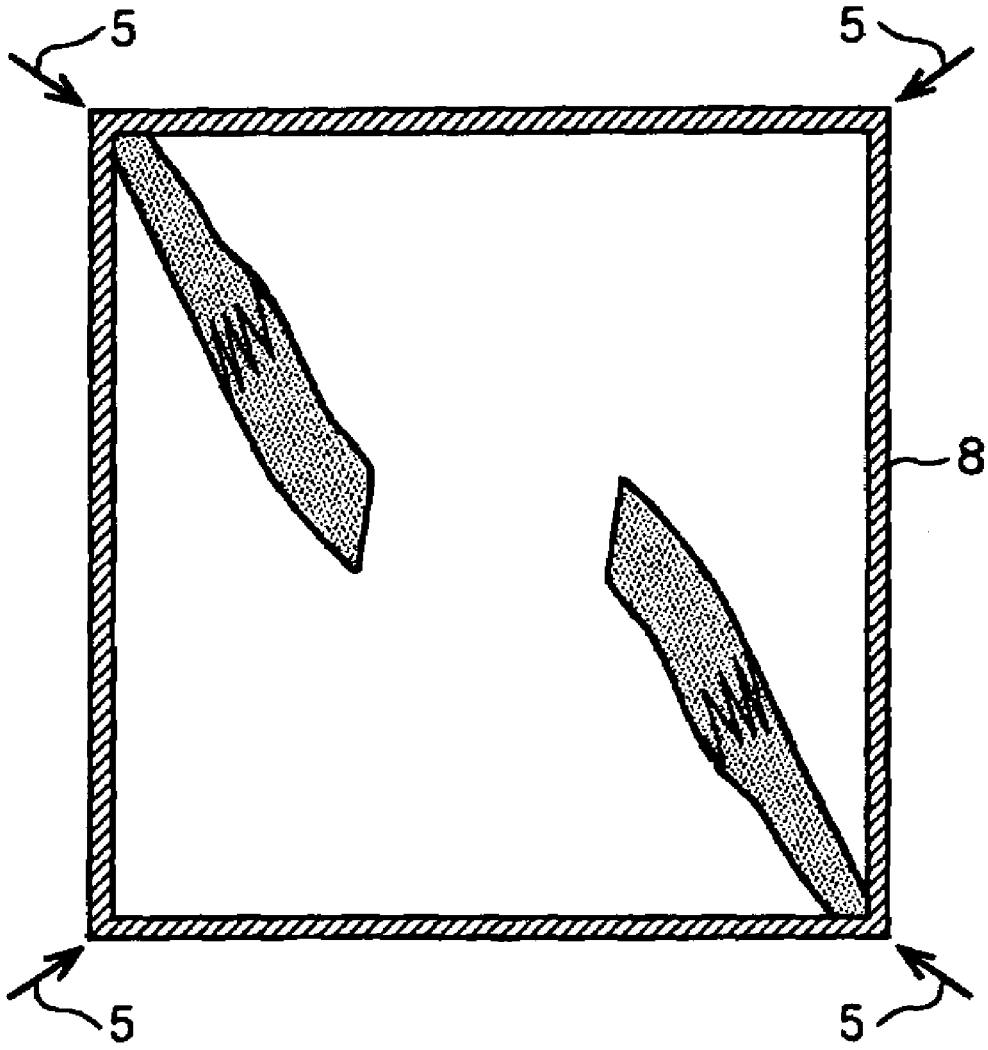
PRIOR ART FIG. 26
FIG. 26 is a horizontal sectional view of the interior of a furnace of prior art during unstable combustion when the load is low.
Figure 27:
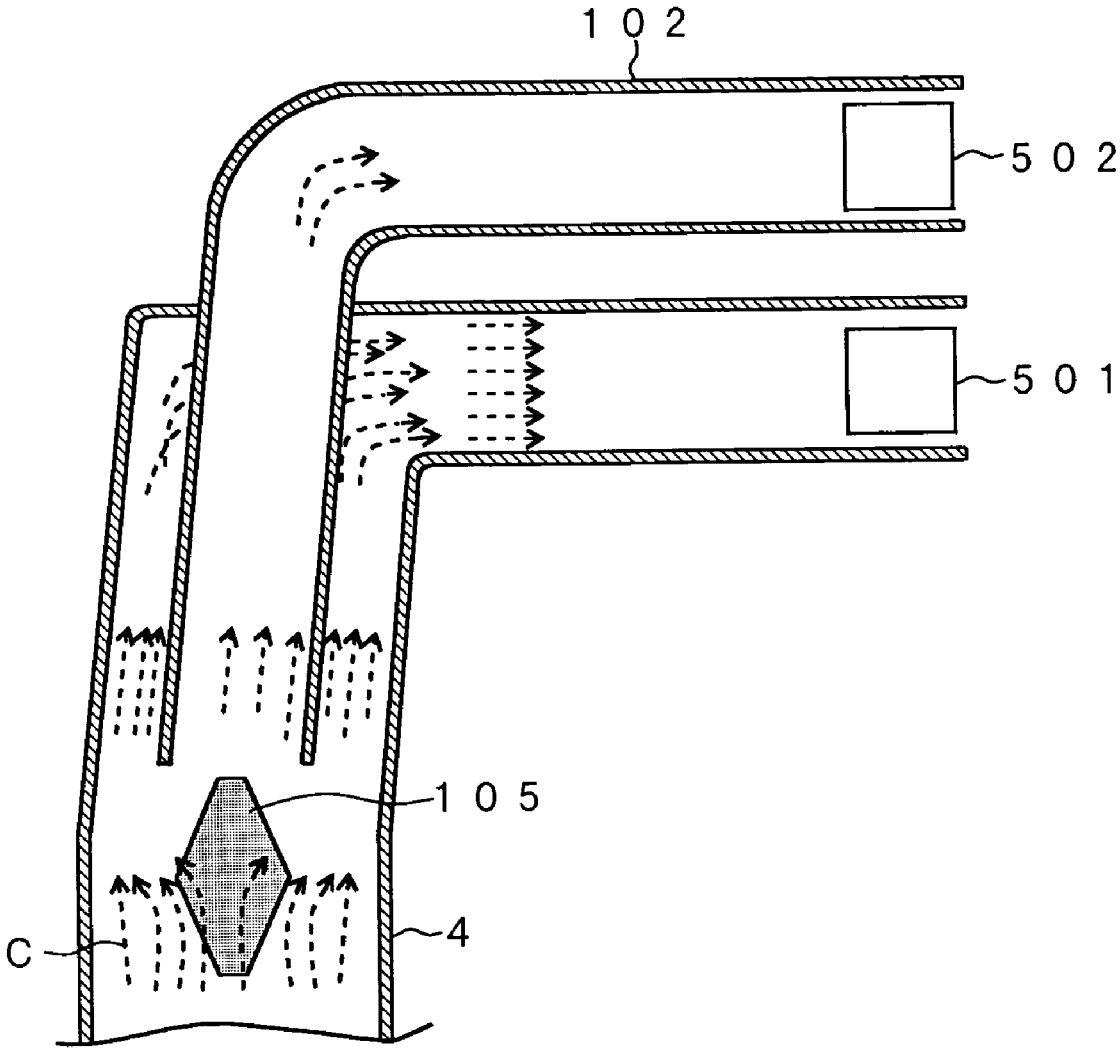
PRIOR ART FIG. 27
FIG. 27 is a longitudinal sectional view of a prior art fuel supply duct.
Figure 28:
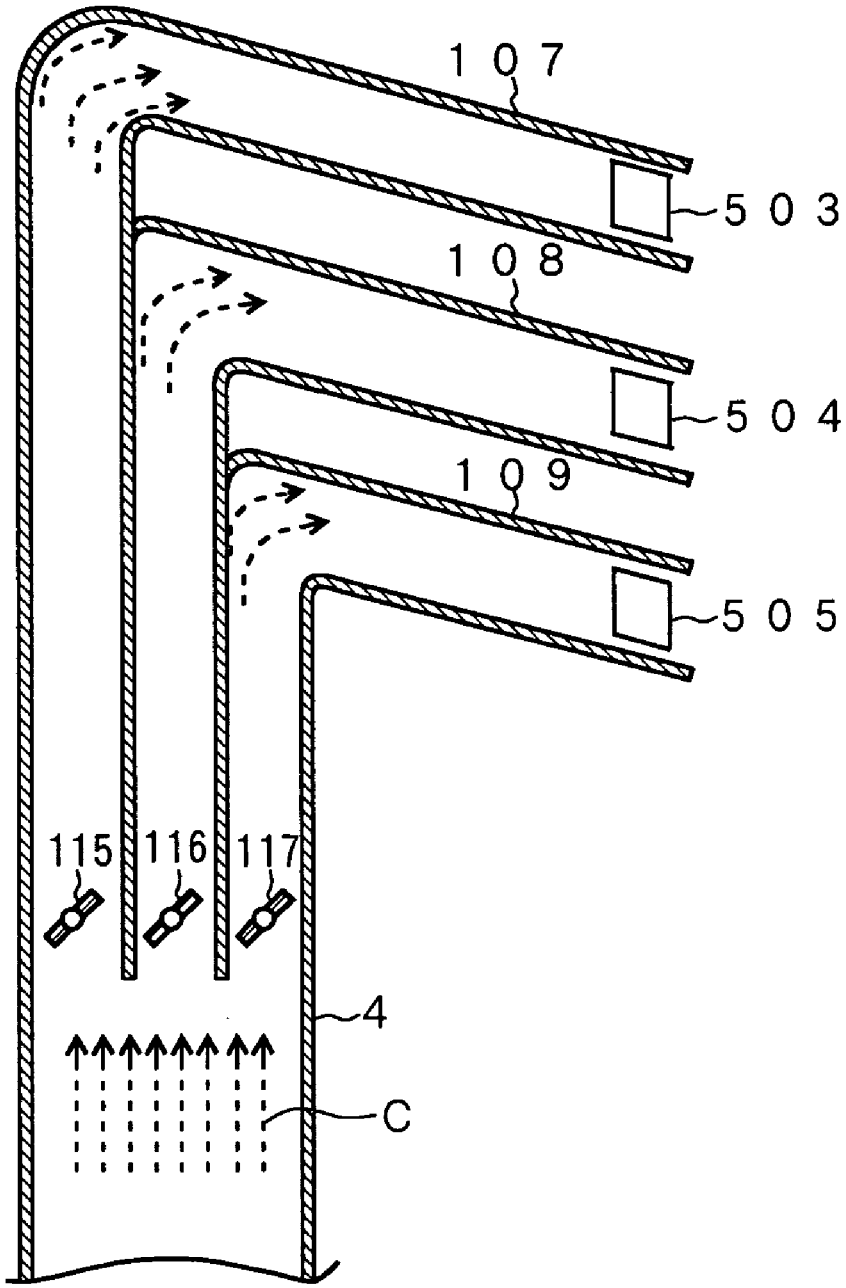
PRIOR ART FIG. 28
FIG. 28 is a longitudinal sectional view of a prior art fuel supply duct.
Figure 29:
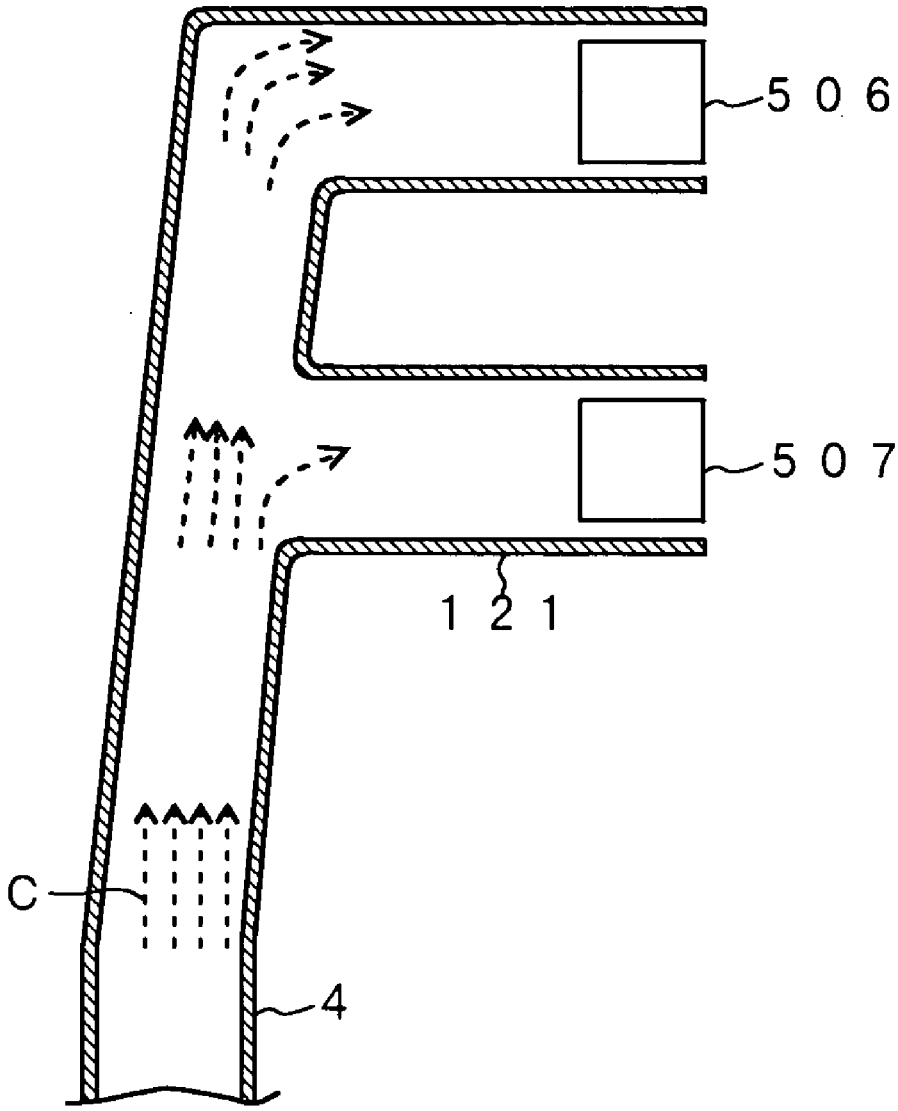
PRIOR ART FIG. 29
FIG. 29 is a longitudinal sectional view of a prior art fuel supply duct.

The fuel distributors for fuel supply duct of the ninth embodiment and the tenth embodiment are shown in FIG. 24 and FIG. 25, respectively.

The ninth embodiment shown in FIG. 24 is an example where branch duct 16, which is connected to the lower stage burner in the fuel supply duct structure of the first embodiment, is provided with a damper 28, with which the opening area of branch duct 16 can be changed from the fully open condition to the fully closed condition The tenth embodiment shown in FIG. 25 is an example where branch duct 16, which is connected to the lower stage burner in the fuel supply duct structure of the fourth embodiment, is provided with a damper 29, with which the opening area of branch duct 16 can be changed from the fully open condition to the fully closed condition.

The branch ducts 15 and 16 of the fuel supply duct structure shown in the above-mentioned FIG. 24 or 25 are respectively connected to burners 5 of stages among a plurality of stages provided in the height direction of the walls or wall corner parts of a boiler furnace 8 shown schematically in FIG. 20. A damper 11, which can be changed in the tilt angle with respect to the direction of flow of the mixed fluid, is provided inside fuel supply duct 4 at the upstream side of the branch ducts 15 and 16 (FIG. 1, etc.). Of the branch ducts 15 and 16, at least branch duct 16 that is connected to the lower stage burner is provided with a damper 28 or damper 29, with which the opening area of branch duct 16 can be changed from the fully open condition to the fully closed condition. Though branch duct 15 may also be provided with a damper 28 or damper 29, with which the opening area of branch duct 15 can be changed from the fully open condition to the fully closed condition, this is not illustrated.

A heat exchanger tube 9 is installed in boiler furnace 8, an example of which is shown in FIG. 20, and an unillustrated heat exchanger tube is also installed in an unillustrated gas flow path at the furnace exit part. Furthermore, a heat exchanger tube is disposed at an unillustrated posterior heat exchanger part of the gas flow path at the downstream side of the furnace exit part.

As has been explained in the prior art section, during full load (100% load) operation of the boiler, the boiler furnace exit gas temperature when the combustion gas reaches the posterior heat exchanger part of furnace 8, is set to be lower than the melting point of the ash that is contained in the gas and is set so that the metal temperature of the heat exchanger tube surface that comprises the heat exchanger tube of the above-mentioned posterior heat exchanger part will not be raised excessively to or above the heat resistance temperature of the surface. However, when the boiler is switched from full load operation to partial load operation, since the amount of heat input into furnace 8 decreases, the gas temperature at the boiler furnace exit decreases and the steam temperature at the boiler exit decreases.

Thus with the ninth and tenth embodiments, damper 11 of fuel supply duct 4 is adjusted in the process of starting up the boiler and damper 28 or 29 inside branch duct 16 is operated and opened to supply coal particles in a concentrated manner into branch duct 16, which is connected to the lower stage burner. Further, when in the change of load after stabilization of combustion, the load changes from a high load to a low load, the damper 28 or 29 in the above-mentioned branch duct 16, which is connected to the lower stage burner, is operated in the closing direction.

By adjusting the damper 11 in fuel supply duct 4 and opening the damper 28 or 29 in the branch duct 16, connected to the lower stage burner, in the process of starting up the boiler, coal particles can be supplied in a concentrated manner into the branch duct that is connected to the lower stage burner and combustion of fuel is secured at lower stage burner 13 in the process of starting up the boiler when the combustion of fuel is unstable. Also, when the boiler changes to low load operation after being in the high load operation condition in which stable combustion of fuel is performed, the damper 28 or 29 in branch duct 16 that is connected to the above-mentioned lower stage burner 13 is operated in the closing direction to make the furnace exit gas temperature sufficiently high for securing the required steam temperature at the demanding end.

Though examples in which damper 28 or 29 is provided in just one branch duct 16 among the two branch ducts 15 and 16 which were illustrated in FIG. 24 and FIG. 25, dampers may be provided in both branch ducts 15 and 16. In this case, with the examples illustrated in FIG. 24 and FIG. 25, a damper is provided in upper stage side branch duct 15 in addition to the lower stage side branch duct 16.

When damper 28 or 29 in branch duct 16 connected to the lower stage burner is operated in the closing direction upon change of the boiler load from high load to low load, the damper installed in branch duct 15 is opened.

Also by providing dampers in both of the branch ducts 15 and 16, the damper (not shown) in branch duct 15 connected to the upper stage burner can be operated in the closing direction when the furnace exit gas temperature is to be lowered, thus enabling adjustment of the furnace exit temperature.

The above-described first to tenth embodiments can be readily applied and designed not only to and for mixed fluids (solid-gas two-phase flows) but also to other flows of two phases that differ in density.

INDUSTRIAL APPLICABILITY

By this invention, coal particles can be distributed at appropriate coal concentrations among a plurality of burners, regardless of coal type, magnitude of load, etc., to promote ignition and stable combustion in the vicinities of burners.

In particular, since coal particles of appropriate concentrations can be distributed among a plurality of burners, the formation of a stable flame in the vicinities of burners is promoted, and since assistance by flame stabilization by separately provided burners is made unnecessary, combustion of coal in a furnace is stabilized even in the low load region of boiler operation where mill cutting becomes necessary. Load-adjusted operation of a wide range is thus enabled.

Also by this invention, the damper can be disposed in a tilted manner with respect to the direction along the flow of the mixed fluid, and with an arrangement in which an elbow (bent part) is provided in the fuel supply duct (main duct), the pressure loss is not increased since the flow path area of the duct is not reduced.

Furthermore by this invention, mixed fluid of a high coal concentration can be supplied to a specific burner even when there is a biased flow of the solid-gas two-phase flow at the entrance part of the damper installed part. Thus even when various accessory equipment are installed in the fuel supply duct (main duct) at the upstream side of the damper installed part, the performance of the supplying of mixed fluid of a high coal concentration to the above-mentioned specific burner at the damper installed part will not be affected and the layout of various equipment can be designed freely. The time required for designing a fuel supply system can thus be reduced and the equipment can be made compact.

Also by this invention, in the case where a boiler using a mixed fuel, comprised of a solid fuel and a carrier gas therefore, is switched from full load operation to partial load operation, the boiler can be operated in a manner whereby the steam temperature at the boiler exit will not fall below the steam temperature required at the demanding end.

What is claimed is:

1. A fuel distributor for a fuel supply duct, comprising a fuel supply duct, which supplies a mixed fluid, comprised in turn of a solid fuel and a carrier gas, to each of one or more burners disposed at walls or corner parts formed by walls of a furnace, a plurality of branch ducts, which branch out from a branching part provided in said fuel supply duct and each of which is connected to a corresponding burner, and a single damper, which is disposed inside the fuel supply duct at an upstream side of the branching part and can be changed in a tilt angle with respect to a direction of a flow of the mixed fluid, wherein a damper pivoting axis, for changing the tilt angle of said damper, is provided near an end part of the damper or a central part of the damper and the damper pivoting axis is disposed at or in the vicinity of a central part of the fuel supply duct with an arrangement by which the following relationship holds for a distance L, from the damper pivoting axis to the branching part in the direction of flow of the mixed fluid, and a diameter D of the fuel supply duct: L/D=0.4 to 2, so that a mutual difference will arise in solid fuel concentrations of the mixed fluid supplied to the respective branch ducts at a part that is located upstream of the branching part, and allowing for maintaining a high concentration of solid fuel toward a specified burner of the one or more burners.

2. The fuel distributor for a fuel supply duct as set forth in claim 1, wherein the tilt angle of said damper with respect to the direction of the flow of mixed fluid can be varied within a range of ±40°.

3. The fuel distributor for a fuel supply duct as set forth in claim 1, wherein a rotating vane, which stirs the flow of the mixed fluid, is provided in the fuel supply duct at an upstream side of the damper.

4. The fuel distributor for a fuel supply duct as set forth in claim 1, wherein a restrictor, which restricts the flow of the mixed fluid, is provided in the fuel supply duct at an upstream side of the damper.

5. A fuel supply system wherein a fuel distributor for a fuel supply duct as set forth in claim 1 is disposed between a solid fuel pulverizing mill and a plurality of burners that are provided on the walls of a furnace.

6. A solid fuel combustion system equipped with a fuel distributor as set forth in claim 1.

7. A fuel distributor for a fuel supply duct, comprising a fuel supply duct, which supplies a mixed fluid, comprised in turn of a solid fuel and a carrier gas, to each of one or more burners disposed at walls or corner parts formed by walls of a furnace.

a plurality of branch ducts, which branch out from a branching part provided in said fuel supply duct and each of which is connected to a corresponding burner, and a single damper, which is dispose inside the fuel supply duct at an upstream side of the branching part and can be changed in a tilt angle with respect to a direction of a flow of the mixed fluid, wherein a damper pivoting axis, for changing the tilt angle of said damper, is provided near an end part of the damper or a central part of the damper and the damper pivoting axis is disposed at or in the vicinity of a central part of the fuel supply duct, so that a mutual difference will arise in solid fuel concentrations of the mixed fluid supplied to the respective branch ducts at a part that is located upstream of the branching part, and allowing for maintaining a high concentration of solid fuel toward a specified burner of the one or more burners.

wherein the fuel supply duct is positioned so that the mixed fluid flows in the vertical direction and is equipped with a first fuel supply duct, in which the damper is installed, and a second fuel supply duct, which is provided at an upstream side of the first fuel supply duct and is connected in a bent manner to the first fuel supply duct.

8. The fuel distributor for a fuel supply duct as set forth in claim 7, wherein the second fuel supply duct is bent in a direction by which the mixed fluid will be guided so as to enhance the difference, in the solid fuel concentrations of the mixed fluid supplied to the respective branch ducts, that is caused by the damper.

9. The fuel distributor for a fuel supply duct as set forth in claim 7, wherein a third fuel supply duct, which causes the mixed fluid to flow in the vertical direction, is connected at an upstream side of the second fuel supply duct.

10. A fuel distributor for a fuel supply duct, comprising a fuel supply duct, which supplies a mixed fluid, comprised in turn of a solid fuel and a carrier gas, to each of one or more burners disposed at walls or corner parts formed by walls of a furnace, a plurality of branch ducts, which branch out from a branching part provided in said fuel supply duct and each of which is connected to a corresponding burner, and a single damper, which is disposed inside the fuel supply duct at an upstream side of the branching part and can be changed in a tilt angle with respect to a direction of a flow of the mixed fluid, wherein a damper pivoting axis, for changing the tilt angle of said damper, is provided near an end part of the damper or a central part of the damper and the damper pivoting axis is disposed at or in the vicinity of a central part of the fuel supply duct, so that a mutual difference will arise in solid fuel concentrations of the mixed fluid supplied to the respective branch ducts at a part that is located upstream of the branching part, and allowing for maintaining a high concentration of solid fuel toward a specified burner of the one or more burners.

wherein a restrictor, which restricts the flow of the mixed fluid, is provided in the fuel supply duct at an upstream side of the damper, and wherein the restrictor has an arrangement that enables a degree of restriction to be changed so as to promote the difference, in the solid fuel concentrations of the mixed fluid to be supplied to the respective branch ducts, that is caused by the damper.

11. A fuel distributor for a fuel supply duct, comprising a fuel supply duct, which supplied a mixed fluid, comprised in turn of a solid fuel and a carrier gas, to each of one or more burners disposed at walls or corner parts formed by walls of a furnace.

a plurality of branch ducts, which branch out from a branching part provided in said fuel supply duct and each of which is connected to a corresponding burner, and a single damper, which is disposed inside the fuel supply duct at an upstream side of the branching part and can be changed in a tilt angle with respect to a direction of a flow of the mixed fluid, wherein a damper pivoting axis, for changing the tilt angle of said damper, is provided near an end part of the damper or a central part of the damper and the damper pivoting axis is disposed at or in the vicinity of a central part of the fuel supply duct, so that a mutual difference will arise in solid fuel concentrations of the mixed fluid supplied to the respective branch ducts at a part that is located upstream of the branching part, and allowing for maintaining a high concentration of solid fuel toward a specified burner of the one or more burners, wherein a branch duct damper, by which an opening area of a branch duct can be changed from a fully open condition to a fully closed condition, is provided inside at least a branch duct that is connected to a specific burner among the plurality of burners disposed in the height direction of the furnace walls or corner parts formed by the walls.

12. A solid fuel combustion boiler operation method, in which coal particles, which have been pulverized by a single coal crushing mill, are supplied along with a carrier gas and via a fuel supply duct and a plurality of branch ducts that branch out from the fuel supply duct to each of a plurality of burners that correspond respectively to the branch ducts and are provided in a plurality of stages in the height direction of walls of a furnace or corner parts formed by the walls of a furnace, wherein a fuel supply duct damper, which can be changed in a tilt angle with respect to a direction of flow of a mixed fluid, comprised of solid fuel and carrier gas, is provided inside the fuel supply duct at an upstream side of said branch ducts.

a branch duct damper, by which an opening area of a branch duct can be changed from a fully open condition to a fully closed condition, is provided inside at least a branch duct, among the branch ducts, that is connected to a lower stage burner, the fuel supply duct damper is adjusted and the branch duct damper connected to the lower stage burner is operated in an opening direction so as to supply the coal particles in a concentrated manner when the boiler is started up, and when by a change of load after stabilization of combustion, the load changes from a high load to a low load, the branch duct damper connected to the lower stage burner is operated in a closing direction.

13. The solid fuel combustion boiler operation method as set forth in claim 12, wherein in the case where each of all branch ducts are provided with a damper, each of which enables the opening area of a branch duct to be changed from a fully open condition to a fully closed condition, the fuel supply duct damper is adjusted and a damper in the branch duct connected to a lower stage burner is operated in the opening direction so as to supply the coal particles in a concentrated manner into the branch duct connected to the lower stage burner when the boiler is started up, and when by the change of load after stabilization of combustion, the load changes from a high load to a low load, the damper in the branch duct connected to the lower stage burner is operated in the closing direction and a damper in the branch duct connected to an upper stage burner is operated in the opening direction.

14. A fuel distributor for a fuel supply duct, comprising a fuel supply duct, which supplies a mixed fluid, comprised in turn of a solid fuel and a carrier gas, to each of one or more burners disposed at walls or corner parts formed by walls of a furnace, a plurality of branch ducts, which branch out from a branching part provided in said fuel supply duct and each of which is connected to a corresponding burner, and a damper, which is disposed inside the fuel supply duct at an upstream side of the branching part and can be changed in tilt angle with respect to a direction of a flow of the mixed fluid so that a mutual difference will arise in solid fuel concentrations of the mixed fluid supplied to the respective branch ducts, wherein the fuel supply duct is positioned so that the mixed fluid flows in the vertical direction and is equipped with a first fuel supply duct, in which the damper is installed, and a second fuel supply duct, which is provided at an upstream side of the first fuel supply duct and is connected in a bent manner to the first fuel supply duct.

15. The fuel distributor for a fuel supply duct as set forth in claim 14, wherein the second fuel supply duct is bent in a direction by which the mixed fluid will be guided so as to enhance the difference, in the solid fuel concentrations of the mixed fluid supplied to the respective branch ducts, that is caused by the damper.

16. The fuel distributor for a fuel supply duct as set forth in claim 14, wherein a third fuel supply duct, which causes the mixed fluid to flow in the vertical direction, is connected at an upstream side of the second fuel supply duct.

* * * * *